United States Patent [19]

Noyes

[11] 4,404,756

[45] Sep. 20, 1983

[54] GRAIN DRYING AND CONDITIONING APPARATUS

[75] Inventor: Ronald T. Noyes, Frankfort, Ind.

[73] Assignee: Beard Industries, Inc., Frankfort, Ind.

[21] Appl. No.: 272,887

[22] Filed: Jun. 12, 1981

[51] Int. Cl.[3] ..... F26B 17/12

[52] U.S. Cl. ..... 34/65; 34/169; 34/174

[58] Field of Search ..... 34/64, 65, 168, 169, 34/174, 56, 54; 432/14, 17, 96, 101

[56] References Cited

U.S. PATENT DOCUMENTS

| | | | |
|---|---|---|---|
| 3,129,073 | 4/1964 | Mathews | 34/56 |
| 3,237,315 | 3/1966 | Benecke | 34/65 |
| 4,048,727 | 9/1977 | Botkins | 34/169 |
| 4,106,212 | 8/1978 | Batterton et al. | 34/174 |
| 4,149,844 | 4/1979 | Noyes | 432/17 |
| 4,249,891 | 2/1981 | Noyes et al. | 432/14 |
| 4,263,722 | 4/1981 | Botkins et al. | 34/174 |
| 4,268,971 | 5/1981 | Noyes et al. | 34/174 |

OTHER PUBLICATIONS

Grain Dryers, Delux Manufacturing Company-Kerney, Nebraska, 68847.

*Primary Examiner*—Larry I. Schwartz
*Attorney, Agent, or Firm*—Henderson & Sturm

[57] ABSTRACT

A cross flow grain drying and conditioning apparatus having an improved grain column configuration wherein the thickness is narrower at the top and bottom thereof than at an intermediate portion thereof for optimumly confining the grain to be dried. A single blower operates to force heated drying air through a first zone of the column of grain and to pull cooling air through a second zone or alternatively to push heated air through both the first and second zones by opening or closing a plenum divider which can be closed to define the zones or opened to combine the zones. An exhaust drying and cooling air recycling structure is provided for regulating the volume of exhaust air versus recycled air in an exhaust area and for blending unsaturated exhaust heated air with incoming cooling air drawn from the second zone or secondly for recycling exhausted drying air from the second zone when using both zones for best drying, or thirdly for exhausting all drying and cooling air when using pressure heating and cool drying. A secondary partial plenum divider and an improved burner also provided for supplying hotter air to the cooler, wetter incoming grain than to the partially dried and warmer grain as such grain moves down through the grain column. The secondary partial plenum divider also includes an opening therein for inspection and for allowing fines to drop out into an automatic cleanout apparatus.

35 Claims, 24 Drawing Figures

MODE I DRYING

MODE II DRYING

MODE III & IV DRYING

MODE IV DRYING

GRAIN DRYING AND CONDITIONING APPARATUS

BACKGROUND OF THE INVENTION

The present invention relates generally to grain drying equipment and more particularly to an improved low profile continuous crossflow column grain dryer with optimum exhaust drying air recirculation through the burner to reduce fuel consumption, automatic preheat of fresh incoming grain, improved drying and cooling airflow volume and cfm/bushel vs blower horsepower by a variable grain column thickness design through both the drying zone and cooling zone, and precise external adjustment for control of grain flow to the metering rolls for optimum drying uniformity along the dryer length.

It is generally believed that continuous crossflow dryers, that is, those dryers which have wet grain continually or semicontinually entering the dryer and dried grain continually or semicontinually exiting (i.e. continuous "periodic unloading" of specific amounts of grain) the dryer, with drying air passing generally perpendicular through the flowing column of grain, were not suitable for drying grains having a high moisture content. The reason for the difficulties experienced in the use of conventional continuous crossflow dryers was that they only operated at their optimum design performance level over a fairly narrow range of moisture removal due to noncontrollable design conditions such as a fixed cooling airflow, and a fixed heated airflow, flowing through a constant width column or a constant depth of grain.

At a grain moisture removal of 6 to 8 percentage points, most conventional dryers work satisfactorily. The cooling rate is matched fairly well with the drying rate. The grain column is usually split 25–35 percent cooling and 65–75 percent heating. The total blower horsepower is normally split at between 30–40 percent cooling and 60–70 percent drying. Dryers with 25 percent cooling column usually use the upper extreme in cooling horsepower, thus operating the cooling plenum at a higher static pressure than the heating plenum and delivering 50–100 percent more cool air per bushel than drying air.

Under conditions wherein grain coming from the field is very high in moisture, and the drying rate is slowed significantly, the grain in such prior art systems was over cooled, which is not a particular problem from the standpoint of the quality of the grain dried, but it does waste considerable energy. Under very dry grain inlet conditions wherein the moisture removal is in the 3–5 percentage range, the grain flow rate is high and cooling is inadequate. If grain conditioned by such a process is to be stored in a non-aerated storage and therefore has to be cooled considerably after being dried in the dryer, the only reasonable solution was to significantly reduce the drying temperature thereby drastically slowing the drying rate to the point where the grain retention time in the cooling zone was adequate to cool the grain. It is well known that the efficiency of the drying process is reduced and the fuel cost per bushel increased considerably when the plenum operating temperature of a crossflow dryer is significantly reduced. It is also well known that the grain to be stored in non-aerated storage cannot be too warm or it will deteriorate rapidly.

Another weakness of most conventional continuous crossflow column grain drying devices is that when drying grains under conditions where cooling the grain in the dryer is not desired, the cooling airflow must be blocked off and the cooling grain column is of little or no value in drying. There is, therefore, a need for improved equipment of this type which will adequately compensate for this situation by having a design that can be easily adjusted to provide drying of grain in the grain column area normally used for cooling to maximize the performance and capital investment of the dryer, and to further increase the efficiency of the dryer by providing suitable means for controlling and recycling the very dry high quality air from the lower zone of the grain column (the cooling zone when dryer is used for cooling) while yet being able to differentiate between and return the exhaust air that is suitable and reject the exhaust air that is unsuitable whether this differentiation should occur (1) within the lower zone, (2) between the lower zone and the lower portion of the upper zone, or (3) within the lower portion of the upper zone.

It is also known that conventional crossflow dryers are normally: (1) of a full pressure design, using positive pressure in a heating as well as a cooling plenum, or (2) designed with suction cooling and pressure heating. But, they do not in one common structure embody the capability to perform in either method with quick and easy adjustment between methods, a management capability thought to be highly desirable, especially in farming regions where grain sorghum (milo) or sunflowers (both of which are crops with abnormally high combustible seed coat particles which accumulate in the heat plenums of dryers that recirculate the suction cooling air through the burner, causing fires in the dryer plenum or grain column) plus other cereal grain crops are grown in one farming operation. Having a dryer capable of being easily converted in a matter of a few minutes would allow full pressure heating and cooling of milo, sunflowers, or other crops with flammable residue, to be dried with the pressure heating and cooling mode of operation using ambient air with no recycled exhaust air. Then, when it is desirable to dry corn, wheat, soybeans or other "safer" crops with residue that is considerably less flammable, the dryer mode can be adjusted for suction cooling plus recycling of the less humid portion (approximately half) of the exhaust heated air without time consuming dryer modifications, thus, reducing fuel consumption by 35 to 50 percent of the fully pressurized heat and cool process fuel costs, while not significantly affecting drying capacity. In some farming and elevator operations, switching drying modes may take place several times per week during the periods when several types of grain are brought in to be dried.

In addition to easy adjustment and control of the direction, volume, and quality of the airflow when changing grains being dried, it is also desirable to adjust the flow profile of the grain as it enters the metering rolls due to the extreme differences in grain density, shape, size, and frictional surface characteristics, relative drying rates, plus trash and foreign material in the grain. For example, soybeans generally have a density of approximately 60 lbs. per bushel, and are relatively difficult to dry. Corn weighs about 56 lbs. per bushel and varies widely in shape from flats to rounds causing considerable variations in airflow and static pressure, and is relatively difficult to dry. On the other extreme, sunflowers, quite often grown on the same farm with corn, soybeans, or wheat, weigh from 24–32 lbs. per bushel but in some years, may be immature and weigh as low as 16–18 lbs. per bushel; sunflowers dry very rapidly at much lower air temperatures and are very light and bulky, thus require a much thicker grain flow to the metering rolls for proper handling rates to avoid extensive modification of the metering drive train which would cause considerable time loss and inconvenience to the operator.

In conventional drawings a uniform common heat level is used throughout the plenum chamber which is lower than desired in the upper portion of the drying column where the grain is wettest, and higher than desirable where the grain exits the drying zone.

There is, therefore, a need for a continuous flow drying apparatus which will overcome the aforementioned problems found with prior art devices.

SUMMARY OF THE INVENTION

The present invention relates to a grain drying and conditioning apparatus having a housing with an outer pervious skin with impervious end walls, air inlet, grain inlet, grain outlet and air exhaust duct structures connected thereto. Air pervious walls are variably spaced within the structure for optimumly confining a column of grain to be dried for desired airflow rates through the grain for optimum hydraulic and thermodynamic efficiency. A blower and heater mechanism is also connected to the housing for causing heated air to be forced through a first zone of the column of grain in one direction to heat and extract moisture therefrom and simultaneously causing air for cooling the grain to be pulled through a second zone of the grain column in an opposite direction, or, by simple adjustments, to be pushed in the same direction as the flow of the heated air. A plenum chamber is formed between the innermost of the pervious walls, the air duct structure, and an impervious wall opposite the air duct structure; an adjustable plenum divider mechanism is provided between the innermost of the pervious walls and the air duct structure in the plenum chamber for selectively dividing the plenum chamber into a first and second section for the purpose of optimizing the heating and cooling of the grain in the first and second zones, or for combining both zones of the plenum chamber for optimum heated air drying in the entire structure.

It is commonly known that most heaters in grain dryers do not uniformly heat the air. The returning exhaust air of this invention mixes with the cooling air to form a blend of relatively dry warm air which is then forced back to the heater at a temperature significantly higher than outside ambient air temperature. This causes the heater to provide much less additional heat to this elevated uniform blend of air to further elevate the drying air to the desired heat plenum temperature level for drying the grain, thus the lower heat rise from the burner provides a safer, more uniform drying temperature than would be obtained by heating outside ambient air all the way to the heat plenum operating temperature level, resulting in a very significant savings in energy needed to dry the grain, as well as providing a safer dryer.

An air recycling structure containing an air impervious skin which encloses the outer pervious skin of the lower section of the drying zone can direct all or a selected portion of the very warm exhausting air back to the inlet of the blower for recycling through the burner, thus re-using the appropriate portion of available waste sensible heat energy to do further drying.

This air duct and specific air control device (exhaust duct volume separator valve), which can first be used for regulating the volume of exhaust air versus recycled air in the exhaust area of the dryer, is provided for blending the unsaturated exhaust heated air, which is forced through the lower portion of the first zone (drying zone) of the grain column area into the exhaust duct structure by pressure, then is sub-blended with incoming cooling air drawn through the second zone (cooling zone) of the grain column area by suction, or secondly, for recycling only the air from a portion of the exhaust duct at the lower portion of the first zone, while rejecting the less desirable air from the duct to atmosphere, thus saving only the energy in such heated air that is desired, or thirdly for exhausting all drying and cooling air when using pressure heat and pressure cooling drying.

Preheating of the cold grain, in cold weather drying, or increased drying zone for improved drying capacity when grain is warm during warm weather drying is provided by extending pervious metal up the lower sidewall of the wet grain supply column (or garner bin) adjacent the top of the outer pervious wall of the drying zone.

Improved control of the dried grain is obtained by providing a precise method of externally adjusting the grain thickness flowing to the metering rolls, while the dryer is or is not drying, such that either a uniform thickness of grain flows to the metering rolls or a non-uniform flow of grain along the metering roll length can be provided, based on and adjusted to grain and air conditions along the length of the dryer. For example, near the fill point of the dryer. For example, near the fill point of the dryer, most of the broken kernel fragments and foreign material settle out and create a more dense grain mass with less air void space, thus reducing airflow and drying. By reducing the grain flow to the meters at that part of the grain columns, slower relative grain flow can provide equally dry grain, eliminating the discharge of wet partially dried grain that can cause serious grain storage problems.

A novel feature of the invention, is an exhaust duct variable control valve means, whereby select portions of the return air below the valve can be returned to the blower for reuse while the remainder of the air above the valve which may be determined to be unsuitable for reuse is rejected to the atmosphere. This valving apparatus (a butterfly type valve is used in this invention although other valve types can be devised) provides a means whereby the exhaust drying air contained by the exhaust duct can be suitably controlled by increments that are adequate for proper dryer management to maintain a high level of drying efficiency for any normal condition of drying encountered. Under certain conditions when drying very high moisture grain, only the air exhausting below the lowest valve position is suitable for reuse. In this condition, the top exhaust doors would all be open and the lowest valve position would be set. When very low moisture grain is being dried to remove three (3) to five (5) percentage points of moisture, it may be desirable to return all of the air that exhausts into the duct. In this case, the valve would be placed in a neutral or vertical position, and the top exhaust duct doors would all be closed.

To maximize the airflow through the lower portion of the drying zone, adjacent the exhaust duct, during all drying conditions, the valve assembly is designed to allow the valve panel farthest from the blower to be maintained in a vertical or neutral position to allow exhausting of air under the valve near the rear of the dryer if blower suction is inadequate, or to pull fresh air into the space through the open section when blower suction is excessive. The top exhaust doors are always open when the valve is placed in either closed position. The end top exhaust door farthest from the blower can also be left open when the butterfly valve is in the neutral or open position to allow the air in the duct to seek a path of least resistance. Thus, in long dryers, some air may be exhausted; in a short dryer, supplemental air may be drawn in by a negative pressure throughout the air duct.

In conjunction with the use of the valves to provide suitable control selectivity of the exhaust air, the width profile of the grain flow path is reshaped to provide an improved structure for the specific purpose of maintaining improved air to grain contact times for each phase of the drying and cooling functions.

It is commonly known in the grain dryer industry that a conventional constant width grain column is simpler and easier to manufacture and that it can provide marginally adequate drying and cooling of grain under a limited range of grain moistures. However, cooling grain with high grain flow rates during low moisture removal drying (3–5 percentage points of moisture removed) is almost always inadequate in conventional dryers. By careful analysis of a wide range of airflow rates through grain columns of several reduced thicknesses, tests confirmed that a thinner grain column than the conventional column thickness (commonly 12 inches) provide significantly higher airflow volume per unit volume of grain; thus, even though the grain retention time is significantly reduced by the thinner grain column, grain cooling increases due to the higher percentage of air volume, which increases at a geometric or non-linear ratio compared to the grain flow velocity which increases at an arithmetic or linear ratio. Thus, the cooling effort is substantially increased. Also a column tapered from the lower drying zone width to a significantly narrower width at the grain outlet of the cooling zone would provide a gradual increase in cooling airflow rate, thus providing "tempered" cooling to the grain in the early part of cooling with the cooling effort accelerated throughout the cooling zone for greatly increased use of all cooling airflow. A narrower column than the conventional column with either parallel or tapered walls significantly improves the grain dryer when combined with the additional control of cooling air volume as provided in this drying method and apparatus design.

In a similar design approach, the grain column thickness in the top portion of the drying zone was analyzed from the standpoint of exhausting the drying air as close as possible to the point where it had physically reached moisture saturation.

It is commonly known in the grain drying industry that air passing through high moisture grain picks up grain surface moisture very easily during what is known as the "Constant Rate" period of drying, where free surface moisture saturates the air by the time it travels only part of the way through the conventional grain column thickness, as compared to drying in the lower portion of the drying zone in what is called the "Falling Rate" period, where the air that exhausts is not saturated. Thus, in continuous flow dryers, it became obvious from analysis of testing that air exhausts at or near saturation over most or all of the upper portion of the drying zone during high temperature drying (180–240° F. Plenum Temperatures), and also that these saturation or wet bulb exhaust temperatures gradually increased to a point at approximately the middle of the drying zone where the exhaust air began to exhaust at less than saturation. This indicates that as the grain temperature rises, there is a saturated air "frontal line" that starts at an intermediate point in the conventional grain column width (near the beginning of the drying zone) and moves gradually outward as the grain moves through the drying zone during the "Constant Rate" period until the front reaches the outer pervious wall at the point where the air starts exhausting at less than saturation, the beginning of the "Falling Rate" period.

Once drying air reaches saturation, ideally it should be exhausted. If it must pass through additional layers of grain which is colder than the air, the cold grain cools the air, lowering the saturation or wet bulb and dry bulb temperatures of the air and because the saturated air cannot hold as much moisture when it cools, part of the vapor in the air condenses on the cold grain. This moisture must be absorbed by more airflow further down the drying column. This "leap frog" effect of absorbing and condensing takes place continually throughout much of the upper drying zone in a conventional width grain column with normal airflow rates.

However, if the grain column is tapered or narrower at the top of the drying zone and widens as it goes down, the air can be exhausted at or shortly after it reaches saturation such that the "saturated air front" approximately parallels the outer pervious grain wall. Thus, little or no rewetting of the grain takes place, the air exhausts saturated at a higher temperature and thus, according to psychrometric data, carries more moisture while being forced through the grain with less pressure or less blower horsepower. Drying fuel efficiency is significantly improved with less power required, improving drying mechanical efficiency. If the original blower horsepower is maintained, the narrower column with a constant plenum pressure results in an overall increase of air velocity and total air volume, thus the drying rate increases and with a lower "dwell time" of air passing through the grain, the saturation front moves farther out in the grain column. Thus, the dryer design must account for the balance point between revised air velocity versus reduced grain column width to establish the grain column design taper or column thickness. To facilitate production, the upper drying zone portion of the grain column may be a compromise of a narrower parallel width that approximates the tapered column while gaining most of the advantage in increased efficiency and performance.

An additional improvement of the dryer is the extension of the pervious outer wall of the dryer onto the lower portion of the wet grain holding column or garner bin. This expanded area of pervious outer wall extends above the adjacent inner pervious wall such that air passes through a diverging grain volume thus causing the first airflow that passes through the grain column to travel slowly to create a tempering or wet grain preheat zone. As the grain thickness reduces air velocity increases until it reaches the minimum thickness of the main drying zone. The air that travels through this preheat zone has a combination path of counterflow and crossflow drying, an excellent tempering preheat airflow design.

It is commonly understood among grain drying authorities that unless grain is very wet, it must be warm before significant moisture removal or drying begins to occur. Thus, preheating to gradually warm the grain is a very desirable function in a high temperature grain dryer to reduce "thermal shock" and stress on the outer kernel structure, reducing stress cracking or "checking" of the grain surface, while gradually expanding the outer layers to induce drying. This helps to maintain a grain kernel that is less susceptible to shipping and storage damage.

Another improvement of the dryer is the capability of applying hotter air to the wettest grain in the top portion of the drying zone and a lower air temperature to grain drying in the "Falling Rate" period of drying in the lower drying zone. This is accomplished by the modification of the burner design from a uniform fuel output throughout the burner manifold to a design incorporating increased levels of output in the upper portion of the burner.

An inclined adjustable deflector duct, used in conjunction with the modified burner, forces an excess volume of the hotter air through an opening in a partial heat plenum floor that extends to a point near the rear of the heat plenum. Fines and foreign material that drops from the upper sloped grain column is blown to the rear and dropped through a gap across the rear of the partial plenum divider into the lower heat plenum adjacent the automatic cleanout device where it is purged from the heat plenum. Removable center panels provide maintenance access to the stationary floor panels along the length of the heat plenum as well as visual access to the upper heat plenum for housekeeping maintenance.

An object of the present invention is to provide an improved grain drying apparatus.

Another object of the invention is to provide an improved apparatus for separatingly controlling the amount of exhaust air released to atmosphere based on the humidity of the portion of the exhaust air coming from the lower exhaust zone compared to the amount of air allowed to recycle for reuse in drying so that the dryer efficiency is further improved.

Another object of the invention is to more directly and precisely control the volume of the dryer exhaust heated air containing economically usable drying energy and return it to the blower for blending with cooling air and free ambient air to reduce the fuel consumption of the device while drying grain, thus providing a dryer of significantly higher efficiency and operating economy then prior art drying systems.

Still another object of the invention is to provide a dryer in which the grain flow to the metering means can be adjusted from external the dryer while the dryer is operating so the dryness of the grain can be controlled along the full length of the drying column by varying the relative velocity of the grain at any point along the dryer length thus significantly increasing the uniformity of grain moisture level, while also being able to easily make precise major adjustments in the grain flow thickness to the metering roll, a very desirable condition when changing from heavy slow drying grains to light density grains that dry very fast.

A further object of this invention is to provide a dryer with properly adjustable temperatures to provide higher temperatures in the upper heat plenum for drying the wettest grain and thus improved drying performance, and a reduced temperature level in the lower heat plenum for final drying of the grain to minimize heat stress and maintain a higher grain quality, while not adding significant complexity to the operation or maintenance of the dryer.

A further object of the invention is to provide a dryer that provides adequate cooling throughout the normally expected range of dryer capacity (4–5 percentage points of moisture removal or more) while having the capability of being adjusted so it will not have to significantly "over cool" at any time.

An additional object of the invention is to provide an improved grain column design that will provide optimum exhaust air efficiency at all points in the "constant rate" drying zone by exhausting the air soon after it reaches saturation so that little or no condensing of moisture takes place on grain before the air is exhausted.

Another object of the invention is to utilize to the maximum the inner pervious drying zone wall area by providing an extended pervious external wall adjacent or above the inner pervious wall, even in the grain holding column or garner bin wall, thus providing tempered preheating of cold grain to reduce thermal stresses which cause stress cracks, to increase the drying zone, or to warm ambient grain.

A still further object is to provide a grain drying and cooling column profile that is substantially improved throughout the course of grain travel by maximizing the use of inner drying area with extended outer drying area beyond the inner level to provide a tempered counter-crossflow preheat airflow pattern, by providing a tapered upper drying zone grain column that parallels and approximates the "exhaust air saturation front", or a narrower column with parallel inner and outer pervious walls that approximate the tapered column, by providing a thicker drying column in the "Falling Rate" or lower drying zone, by developing a tapered or narrower parallel walled cooling zone to provide improved cooling capacity, and externally controlled metering flow gates at the outlet of the grain column that can provide precisely controlled variable grain velocities along the length of the metering rolls so that variations in airflow and or air temperature within the plenum can be compensated for.

Other objects, advantages and novel features of the present invention will become apparent from the following detailed description of the invention when considered in conjunction with the accompanying drawings.

DESCRIPTION OF THE PREFERRED EMBODIMENTS

Figure 1:
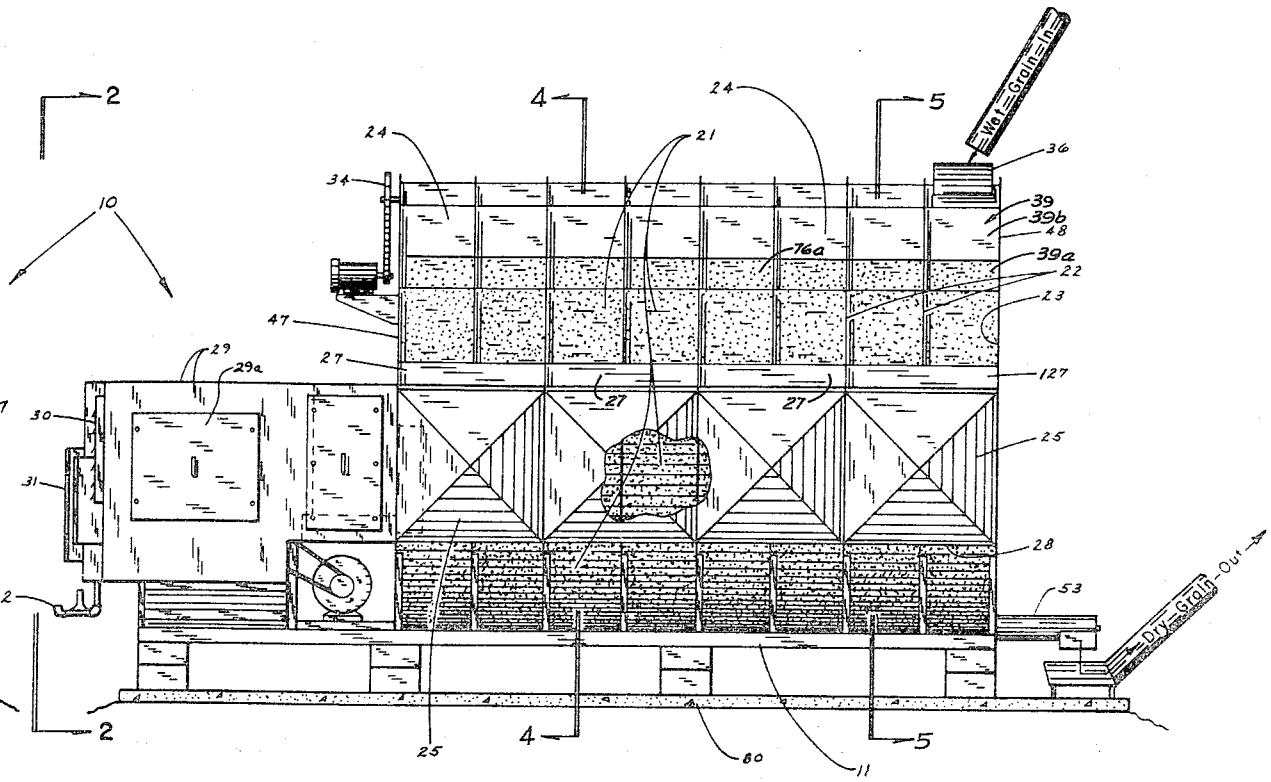
FIG. 1 is a side elevational view of a preferred embodiment of the present invention.

Referring now to the drawings, wherein like reference numerals designate identical or corresponding parts throughout the several views, FIG. 1 shows a framework of the grain dryer 10 constructed in accordance with the present invention which has an outer pervious skin 21 attached to intermediate structural members 22, and structural outer end members 23 which is attached to the outer grain column retaining wall and extends slopingly from the base of the pervious garner bin wall 39*a* down the vertical sidewall behind an impervious air return duct wall 25, then along the lower slope structure attached along the center of the dryer to base frame 11. A basic grain dryer 10 of this type is shown in U.S. Pat. No. 4,268,971 to Noyes, et al., which is incorporated herein reference.

Figure 4:
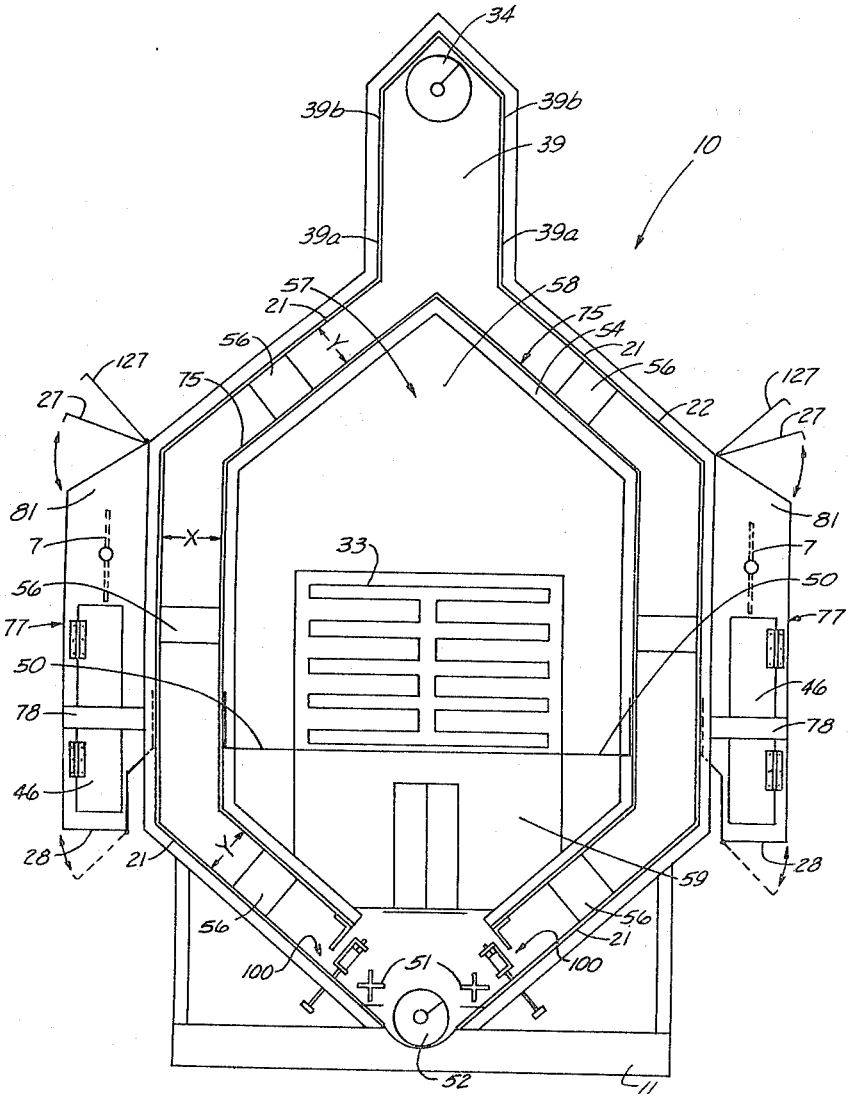
FIG. 4 is a cross-sectional view taken along line 4—4 of FIG. 1 but operated with the top exhaust doors open.

The return air duct 25, along the sidewall, has top exhaust vent doors 27 and 127 and bottom exhaust vent doors 28 to allow control of exhaust air for returning through return air control doors 46 to the inlet opening 41 of air circulation blower 40, as can best be seen in FIG. 4, which is housed inside an air return duct housing 29 which completely encloses the centrifugal blower 40.

Ambient air inlet louvers or vents 30 are shown in FIGS. 1, 2, 3, 7 and 11. Electrical control equipment is generally housed in control box 31 which is mounted adjacent the fuel plumbing train 32, FIGS. 1 and 2.

Figure 2:
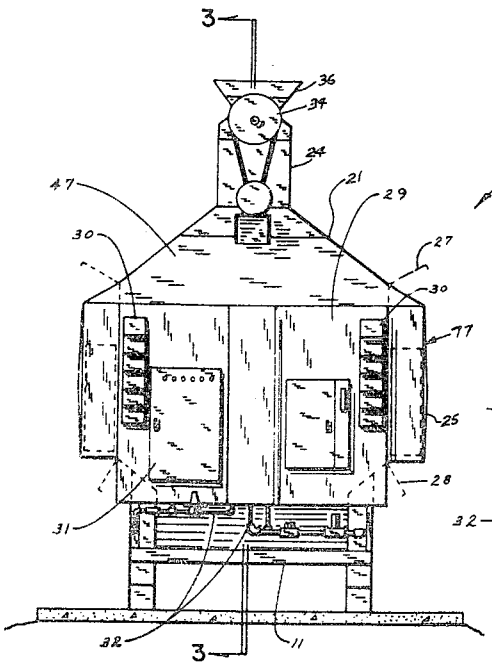
FIG. 2 is a front view of the invention taken along line 2—2 of FIG. 1.
Figure 5:
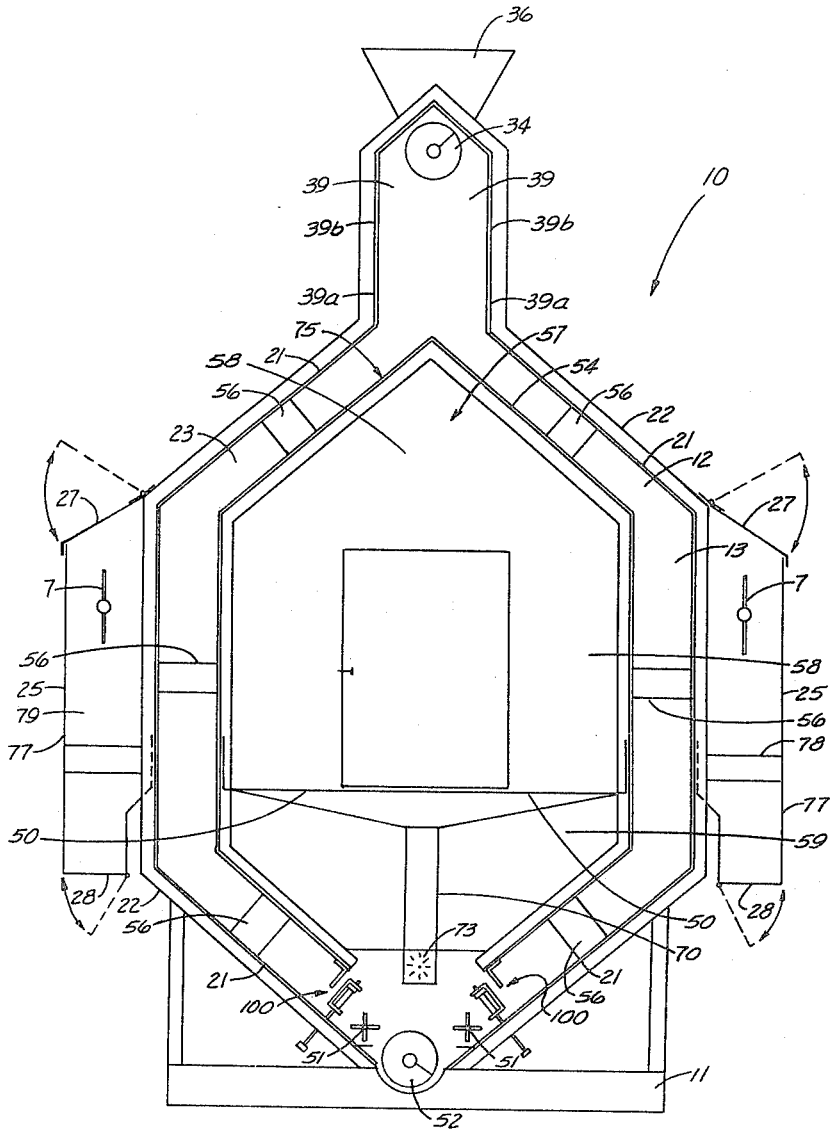
FIG. 5 is a cross-sectional view taken along line 5—5 of FIG. 1.
Figure 6:
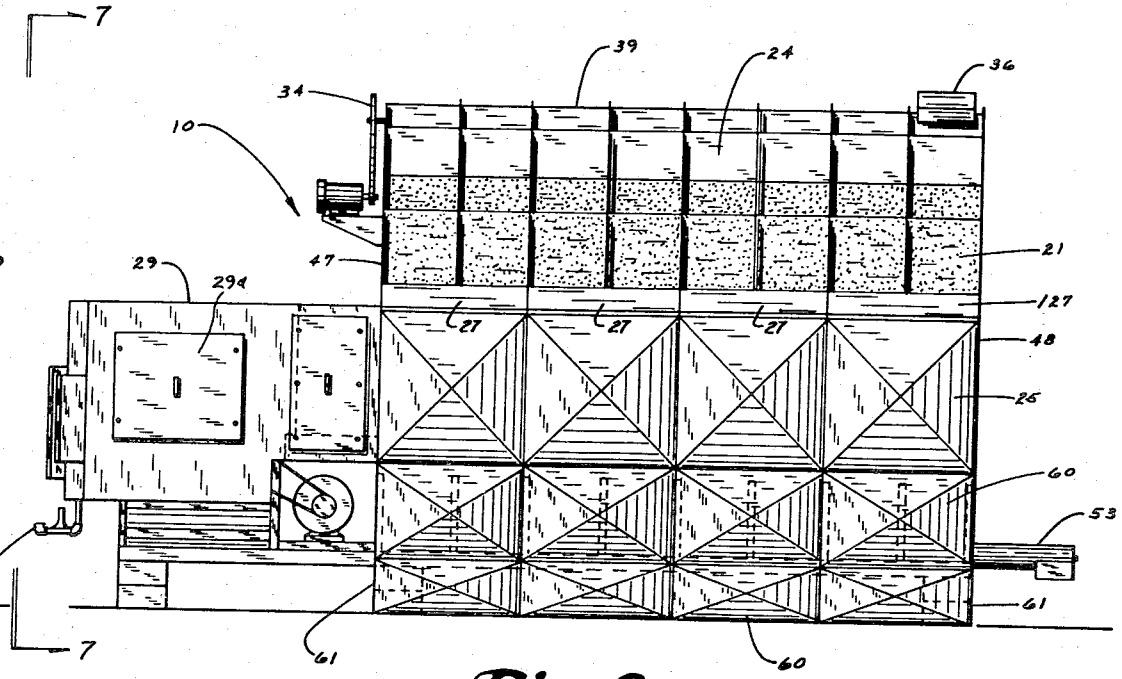
FIG. 6 is a side elevational view of the preferred embodiment of the present invention showing solid panels connected to the exhaust duct and enclosing the base of the dryer.
Figure 7:
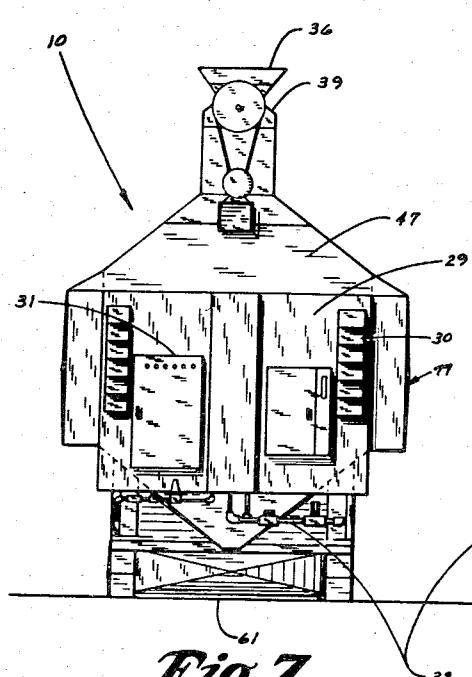
FIG. 7 is a front view of the preferred embodiment taken along line 7—7 of FIG. 6.

Grain is conveyed to the dryer fill hopper 36, FIGS. 1 and 2, where it flows by gravity into the grain column 12 (FIG. 5) contained by outer pervious wall 21, FIG. 5, and inner pervious wall 75, FIG. 5. The grain fills the grain column 12, between the inner walls 75 and the outer wall 21, FIG. 5, and is contained at the lower end by metering roll 51, FIG. 5. When the grain reaches a sufficient volume, the grain is leveled by leveling conveyor 34, FIG. 5, until the dryer grain column and the garner bin 39 (FIG. 5) is filled. Henceforth, grain level sensing controls cause the leveling auger to operate periodically, keeping the dryer filled as the dry grain is discharged by meters 51 into unload conveyor 52 where it exits from the dryer through grain unloading duct 53, FIGS. 1 and 6.

Once the dryer has been filled with wet grain, the blower 40 (FIG. 3) is energized through use of control devices in control panel 31 (FIGS. 1 and 2). The air from the blower passes across the burner 33 best shown in FIGS. 3 and 4, where it is heated to the desired level by fuel controlling devices in the fuel plumbing train 32 (FIG. 1) that monitor the fuel flow to the burner 33.

Referring to FIGS. 1, 4 and 5, it is noted that the dryer body is formed by an assembly of the outer grain column structural end 23 and intermediate structural members 22 attached to pervious outer skin sheets 21 with structural spacing members 56 (FIG. 5) separating the outer pervious skin assembly 21 from a similar inner pervious skin assembly 75 consisting of inner grain column end structural members, FIG. 1, and intermediate structural member 54 (FIG. 5) attached to pervious inner skin panels 75 (FIG. 4), such that a grain column of variable thickness is formed. Note that in FIGS. 4 and 14–16, the width x of the intermediate portion of the grain column is wider than the distance y of the upper portion and lower portion of the grain column. These pervious inner and outer skin assemblies are further enclosed across each end of the grain bed by front bulkhead sealing panels 47 (FIGS. 1 and 2) mounted adjacent to the blower and rear bulkhead panel 48 (FIG. 1); thus, the grain metering assembly 51 restrains the grain at the bottom of the grain column and controls the grain velocity through the column by the variably controlled speed of the metering rool 51 (FIGS. 4 and 5) combined with the variable setting of the externally adjustable metering gate assembly 100, best seen in FIGS. 8 and 9.

Figure 11:
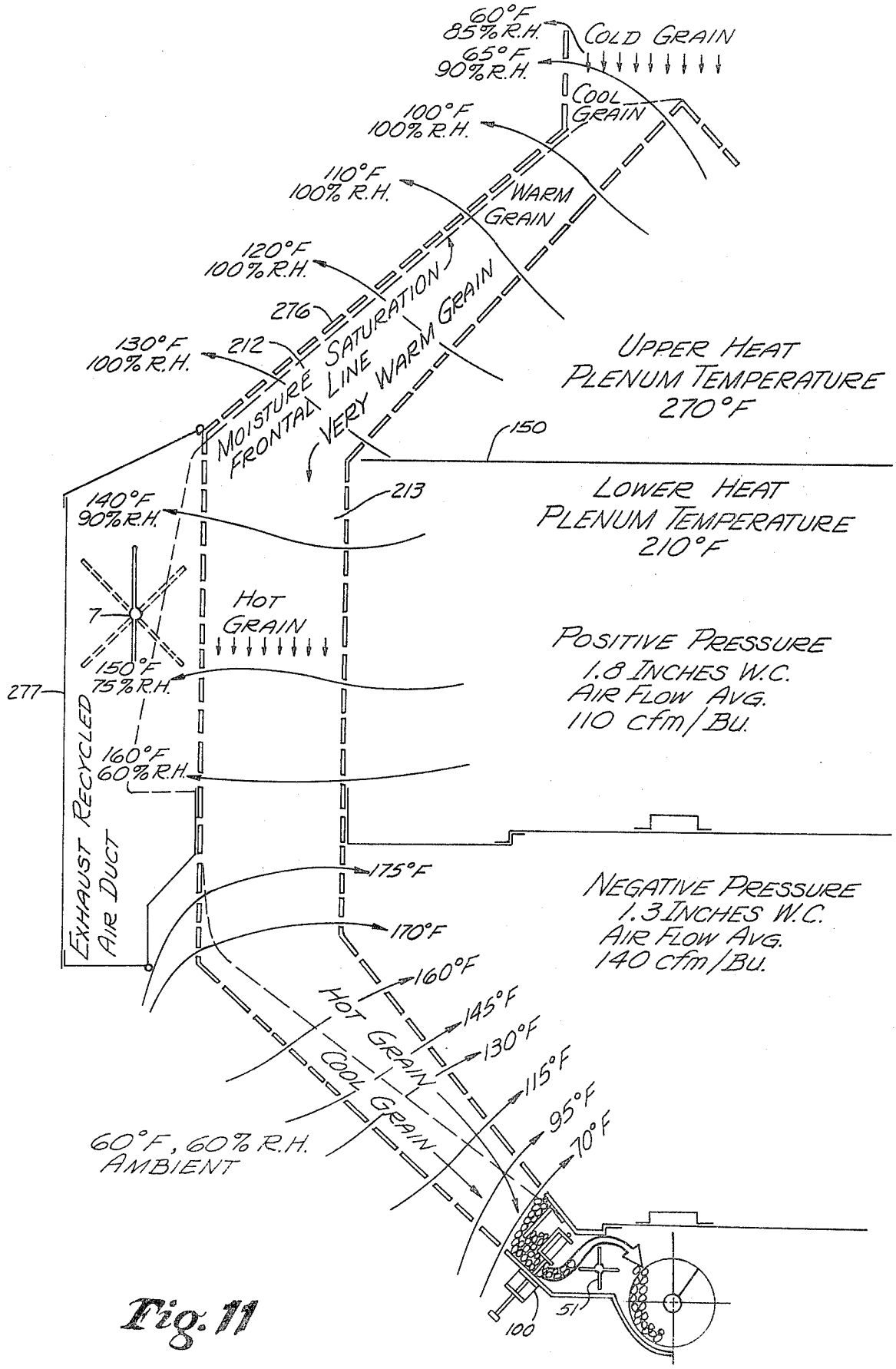
FIG. 11 is a partial cross-sectional view at section 5—5 of FIG. 1 of an improved tapered drying and cooling column showing typical temperatures and relative humidities.
Figure 12:
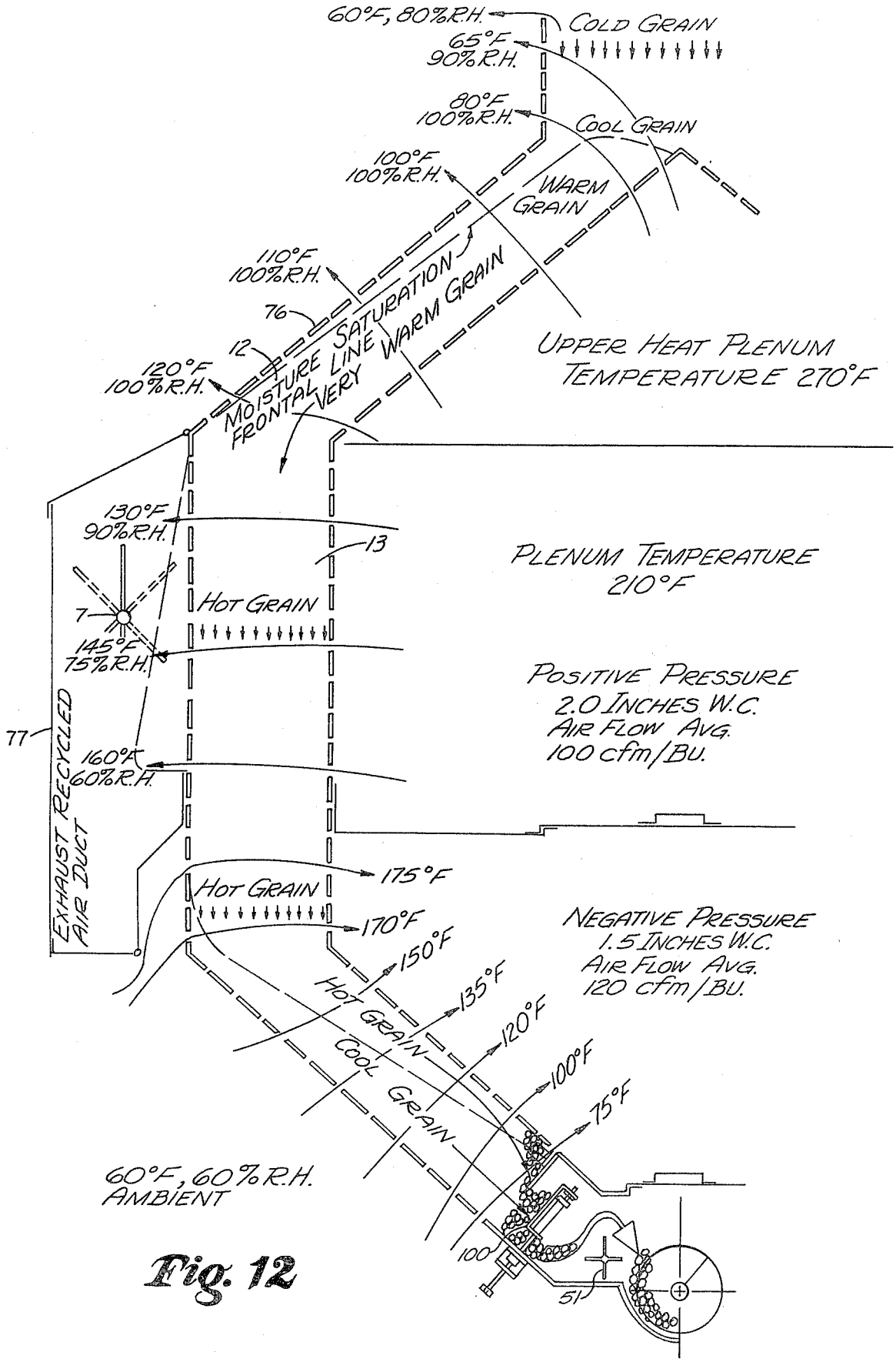
FIG. 12 is a partial cross-sectional view at section 5—5 of FIG. 1 of the improved narrowed parallel drying and cooling column, shown also in FIGS. 4 and 5, showing typical temperatures and relative humidities.

The exterior grain column perforation 20 in panels 21 (FIGS. 10–12) are extended part way up the side of the wet grain holding column 39 (FIGS. 4 and 5) with 39*a* indicating the perforated part of panel 39 and 39*b* indicating a non-perforated portion, providing tempered preheating of the wet grain with a reduced air velocity that gradually increases as the grain approaches the top of the narrow drying column formed between perforated walls 21 and 75 (FIG. 12). The narrow grain column in the upper portion of the drying zone is found to be most suitable when the average thickness of the upper tapered column 212, FIG. 11, or the width of the narrow parallel column 12 of FIG. 12, is approximately 70 to 75% of the width of the lower portion 13 of the drying zone. The tapered section varies from approximately 60% (at the top) to 85% at the bottom of the width of the wide lower portion of the drying zone, or a taper of from 7 to 10 inches compared to a 12 inch lower drying column width. This thickness provides a very efficient drying process for a variety of grains and a wide range of moisture contents during the "Constant Rate" or surface moisture portion of drying where moisture removal occurs very rapidly. The thicker parallel section 13 in the lower portion of the grain column 12, FIGS. 4, 5 and 12, causes a significant reduction in air velocity, thus greatly increasing the dwell time of the air in contact with the grain for efficient drying during the "Falling Rate" period of drying.

Figure 10:
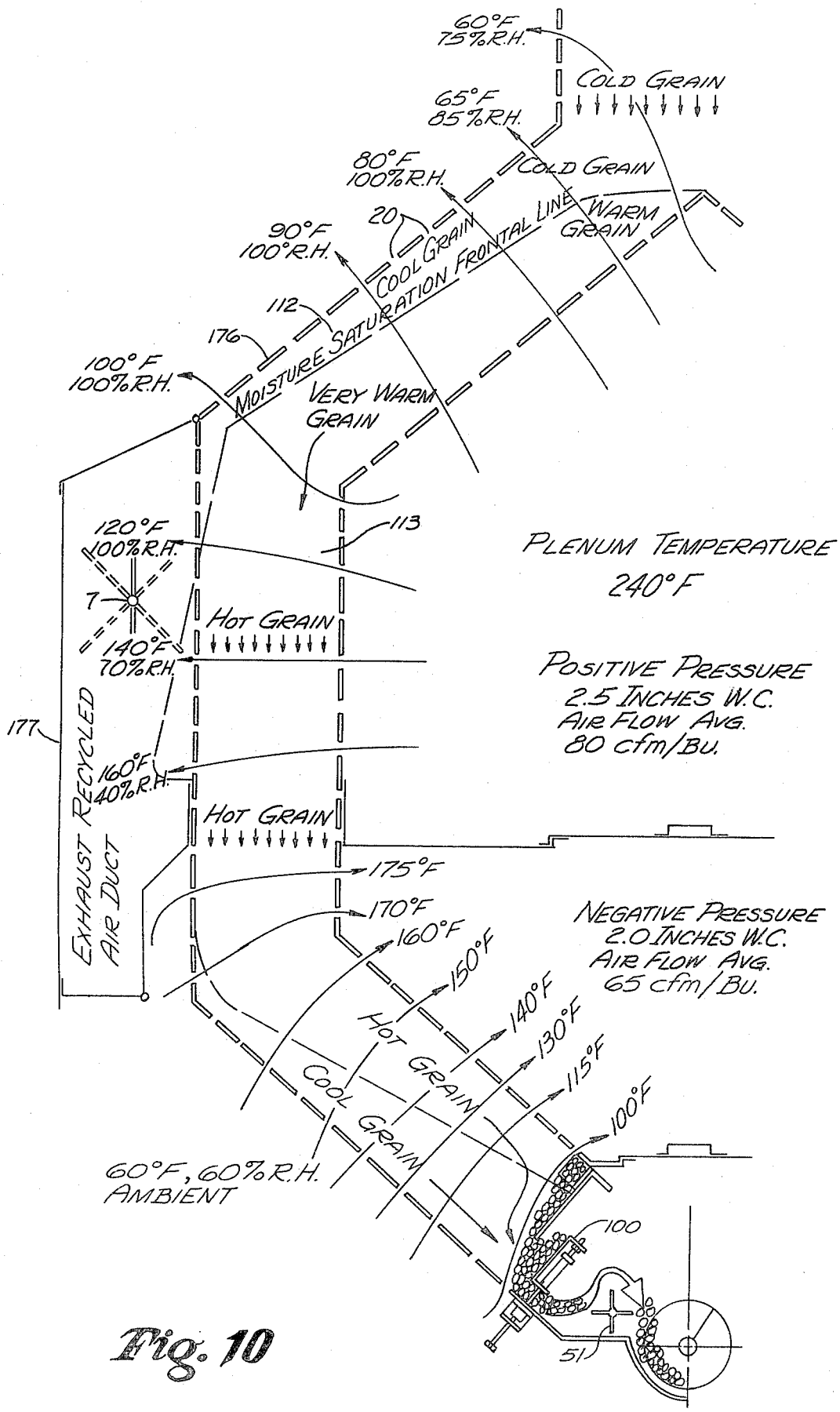
FIG. 10 is a partial cross-sectional view like section 5—5 of FIG. 1 of a conventional grain column, such as shown in U.S. Pat. No. 4,268,971, showing typical temperatures and relative humidities.

The narrower upper drying column 39*a* combined with the added preheat zone on the wet grain holding column wall, provides significantly improved drying conditions as illustrated in the illustrations in FIGS. 11 and 12, the narrow tapered and narrow parallel columns, respectively, as compared to the wide conventional upper zone column 112 of FIG. 10. The exhaust temperatures and relative humidities reach higher saturation temperatures much farther up the slope and exhaust air velocities are considerably higher with the narrow column. This improved dryer performance results from the air being able to exhaust very soon after reaching initial moisture saturation.

Air in the conventional column may reach the same saturation temperature, yet have to travel through the remaining 15 to 40% of the grain column passing through grain with lower temperatures than the grain at the moisture saturation frontal line; thus, the air is chilled as it gives up its sensible heat to the cooler grain. As the air cools, it can no longer retain the amount of moisture it could hold at higher temperatures, so moisture condenses on the grain the remainder of the distance until it exhausts. Thus, moisture is continually absorbed and condensed as the grain travels downwardly until the air reaches moisture saturation, just as the air passes through the outer grain column wall. The narrow column's profile approximates the moisture saturation frontal line for design conditions that account for the increased airflow with the reduced grain thickness, providing an improved drying zone as more drying can be done with the same or reduced blower horsepower.

The width of the upper portion 12 of the cooling zone continues at the same width of the lower portion of the drying zone (FIGS. 4, 5 and 12) for (1) ease of construction, and (2) to provide a reduced air velocity tempered cooling condition initially. The lower portion of the cooling zone is a reverse mirror image of the upper portion of the drying zone (FIG. 11 or FIG. 12).

For cooling, the ideal average narrow grain column thickness is slightly less than in the narrow drying column, in order to develop higher cooling airflow rates without requiring excessive suction pressures. Sixth-five (65) to seventy-five (75) percent average width, as compared to the middle portion 13 of the grain column, provides an adequate cooling column for the narrow tapered or parallel column.

The narrow cooling column provides greatly improved cooling as shown in the exhaust temperature conditions in FIGS. 11 and 12 compared to the conventional cooling shown in FIG. 10. Computer analysis, verified by dryer prototype testing, demonstrates that as grain column thickness is reduced, airflow velocities increase as a geometric or non-linear function of the thickness for a given static pressure, compared to the linear or arithmetic change in grain volume that the airflow is exposed to. So, even though the grain velocity increases through the narrow column to maintain the same total throughput rate, the net volume of air per bushel of grain, and thus the net cooling capacity, is greatly improved.

This may not be critical when grain moisture removal is high and dwell time in the cooling zone is long, but when grain moisture removal is low and grain velocity through the cooling zone is high, and when grain must be cooled to within 10° F. or less from the ambient cooling air temperature, it becomes very important. Many commercial drying installations dry the major portion of their grain during the season while removing five (5) percentage points of moisture or less. With conventional dryers, there is only one safe way to be assured of adequately cooled grain, and that is to reduce the drying rate by reducing drying temperature to provide for an adequate dwell time for the grain in the cooling zone.

Referring again to FIG. 5, the cavity formed between the end bulkhead panels 47 and 48, and the pervious inner wall 75, is the air plenum 57. This volume is further defined by plenum divider panels 50 into a first zone volume 58, used for conveying and distributing heated air into the grain column 12, and a second zone volume 59, used primarily for suction flow cooling or pressure flow cooling of the grain, but which can be secondarily used for heated air from the burner 33 (FIG. 4) to be uniformly distributed through the full plenum chamber 57.

The exhaust air return duct structure 77 (FIG. 5) is mounted adjacent the intermediate or vertical portion of the grain column outer wall 21. This structure consists of sidewall panels 25, and sidewall mounting brackets 78, sealed at the end opposite the blower 40 by an end bulkhead panel 79, FIG. 5. The top is enclosed by adjustable air exhaust panels 27 and panel 127 and the bottom by adjustable cleanout panels 28. At the front end of this duct the return air control door 46 for opening or closing the opening 146, best viewed in FIGS. 4(closed) and 14(open), is used to control the exhaust of hot air. A bulkhead member 81 (FIG. 4) seals around the return air control door 46.

Figures 13, 20:
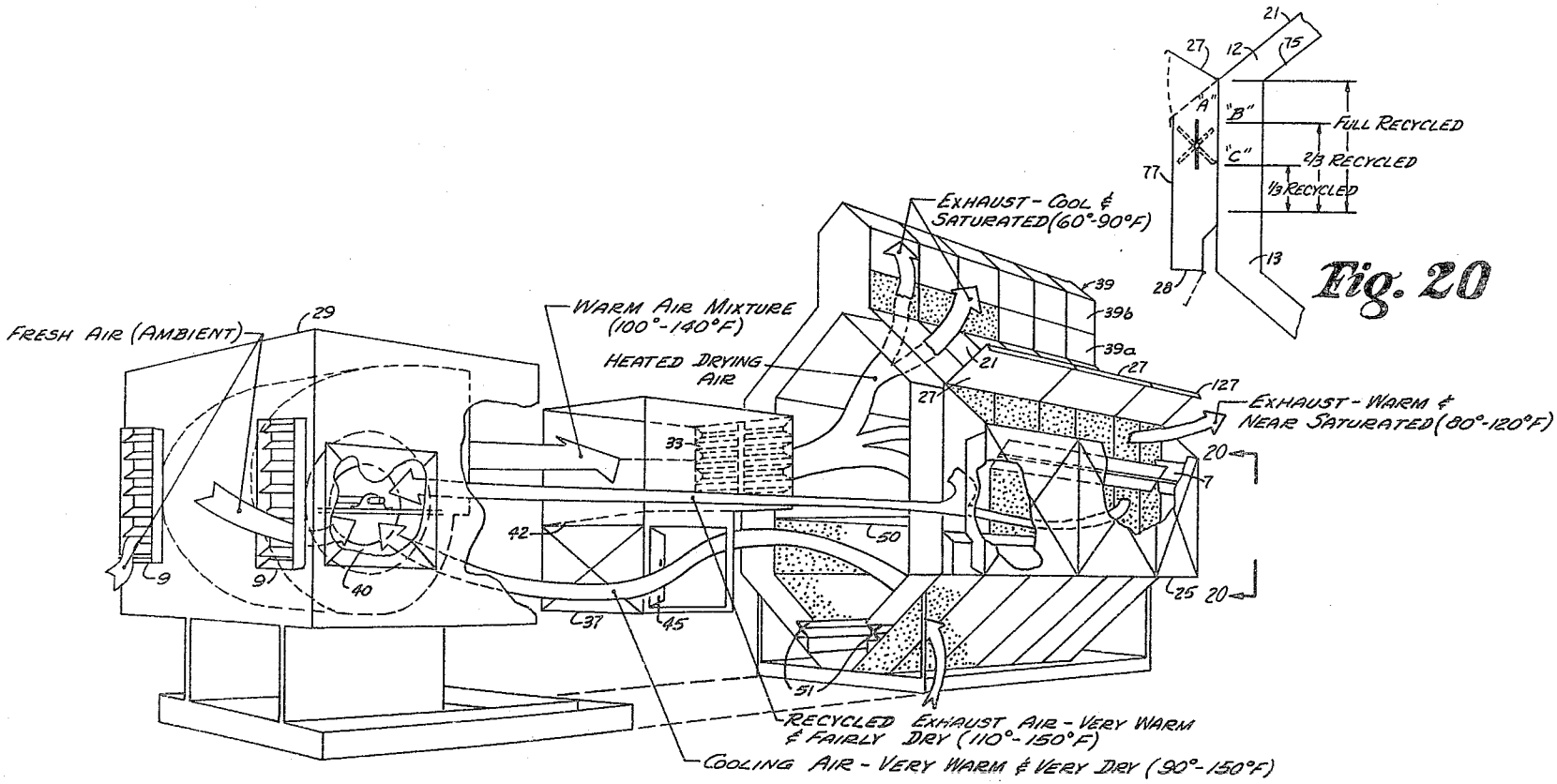
FIG. 13 is a partial cutaway segmented isometric view of the preferred embodiment showing features and airflow patterns for Mode I drying; i.e., pressure heating and suction cooling with recycled air from the cooling zone and lower part of the drying zone, with an exposed end view of the grain column profile.
FIG. 20 is a schematic similar to FIGS. 4, 14, 15 and 16, showing three operating positions of the butterfly valve during Mode I drying.

A vitally important and novel part of the exhaust air duct assembly is the exhaust air flow separator valve assembly 7 of FIGS. 4, 5, 13–19, 20 and 24. Althrough this function could be performed by various adjustable valve or duct divider panel means, such as a single open or closed door panel arrangement, the preferred embodiment is designed with a novel butterfly type valve assembly 7 that extends laterally essentially the full length of the exhaust air duct as shown in FIG. 13. The pivotally mounted butterfly valve panel length and pivot position was designed to divide the pervious exhaust wall outlet area into specific desirable increments. A smaller second butterfly segment 17 is slideably disposed on the pivot rod of valve 7 and can be moved with regard to the butterfly valve 7. The purpose of segment 17 is to prevent a build-up of pressure in duct 77 that would reduce the flow of air through pervious panel 21 into duct 77 to an unacceptable level, when the valve 7 is in one of closed positions B or C (FIGS. 13, 15, 16 and 19).

When the valve 7 is rotated such that the top of the panel 7 rests against the pervious exhaust wall of the grain column (FIG. 15), the bottom of the panel rests against the impervious outer wall of the exhaust duct, forming an inclined sealing floor divider panel such that exhaust air flow below the divider panel, position B of FIG. 20, is drawn to the inlet to the blower 41, FIG. 3. The airflow exhausting above the divider panel is released through open top exhaust doors 27, FIG. 15. This provides a condition whereby approximately $\frac{1}{3}$ of the airflow is exhausted to atmosphere and about $\frac{2}{3}$ of the airflow is recycled to the blower for reuse of the sensible heat.

Conversely, when the pivotal divider or butterfly valve panel 7, FIG. 13, is rotated the opposite direction (position C of FIGS. 14 and 16) such that the bottom of the panel contacts the pervious grain wall and the top side touches the impervious outer wall of the exhaust duct, approximately $\frac{2}{3}$ of the exhaust air volume that enters the duct is exhausted to atmosphere and $\frac{1}{3}$ is recycled.

Figure 14:
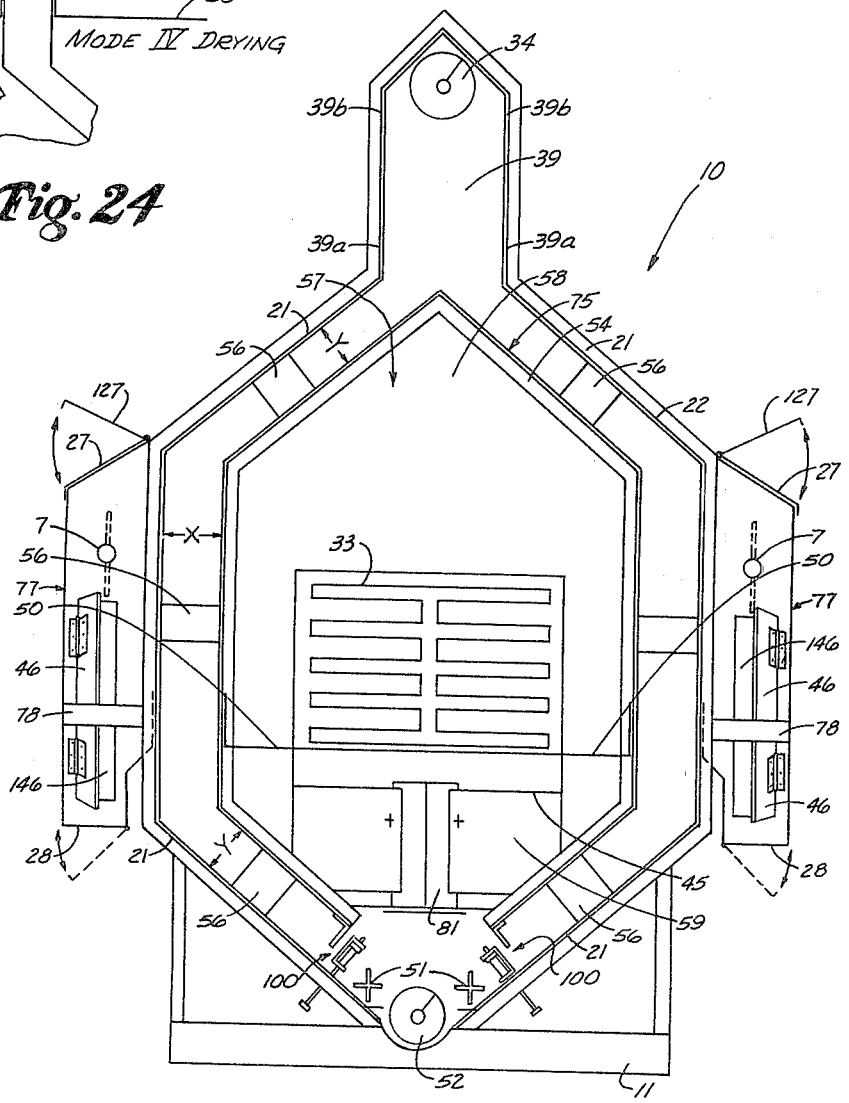
FIG. 14 is a cross-sectional view taken along line 14—14 of FIG. 13 showing butterfly valves in a first open position A.
Figure 15:
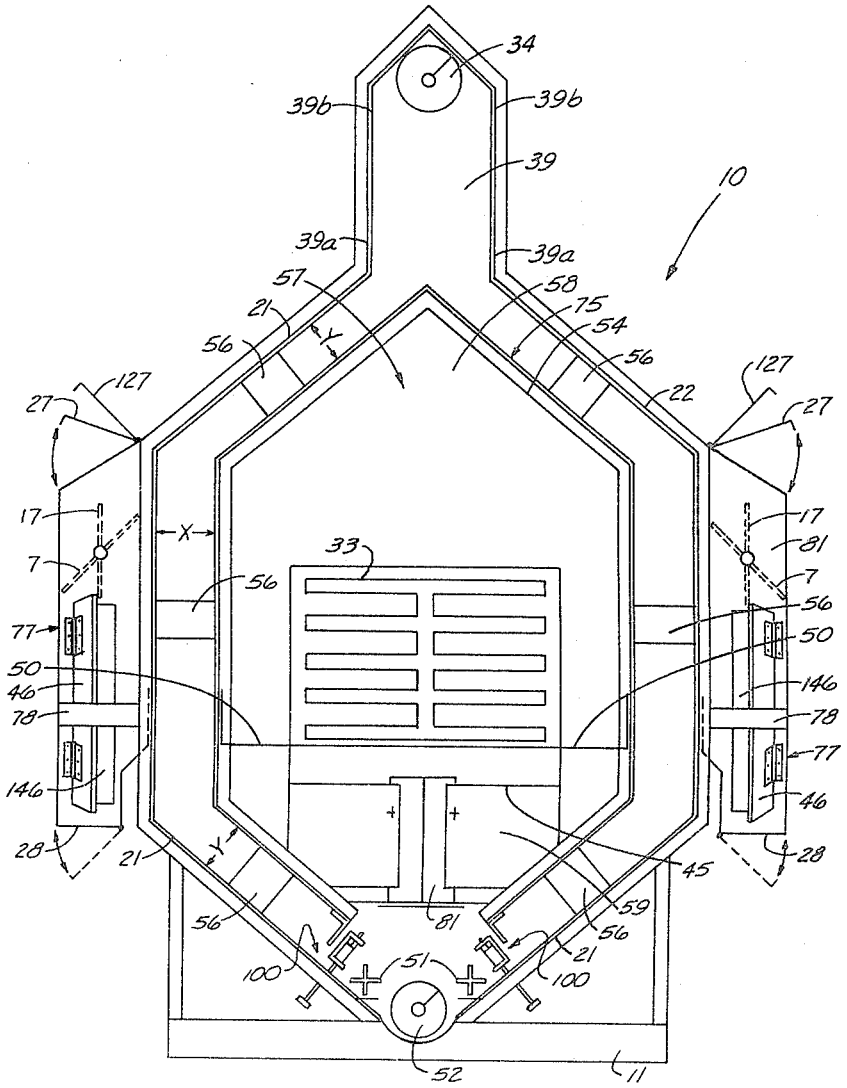
FIG. 15 is a view like FIG. 14, but showing the butterfly valve in a second position B.
Figure 16:
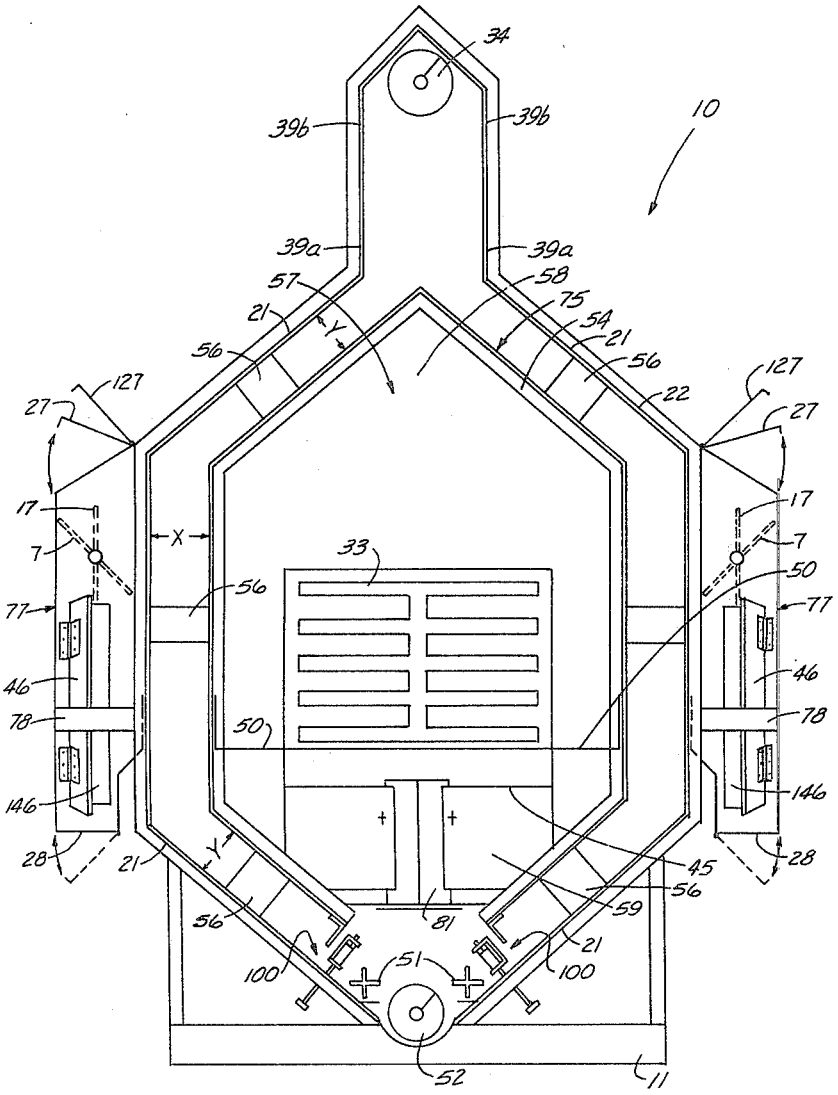
FIG. 16 is a view like FIG. 14, but showing the butterfly valve in a third position C.
Figure 17:
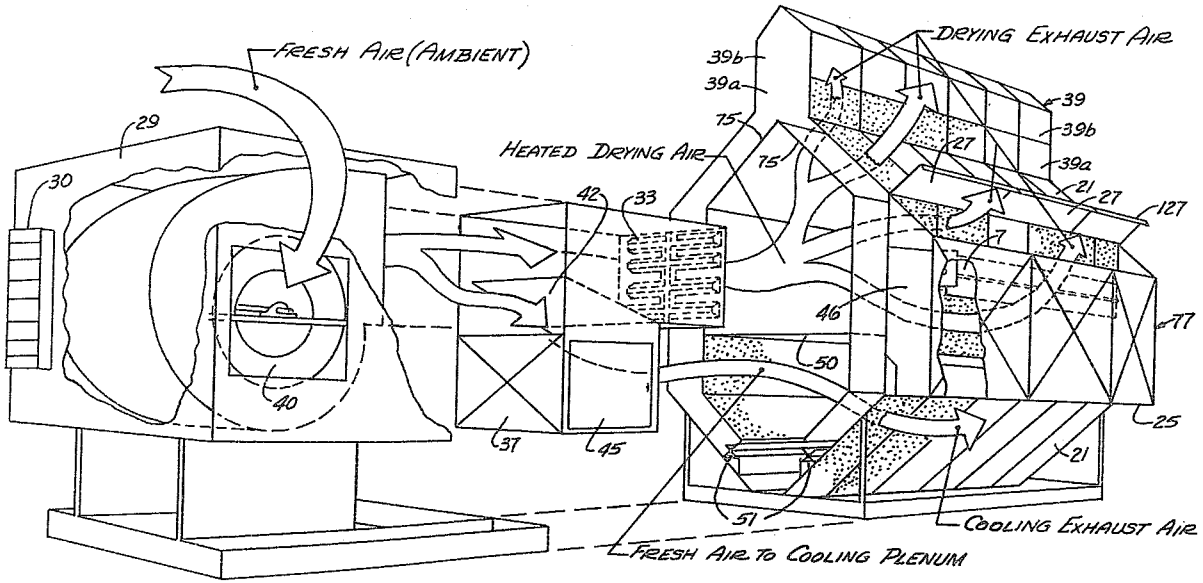
FIG. 17 is a partial cutaway segmented isometric view of the preferred embodiment showing the airflow patterns during Mode II drying; i.e., pressure heating and cooling with full exhaust, with an exposed end view of the grain column profile.
Figure 18:
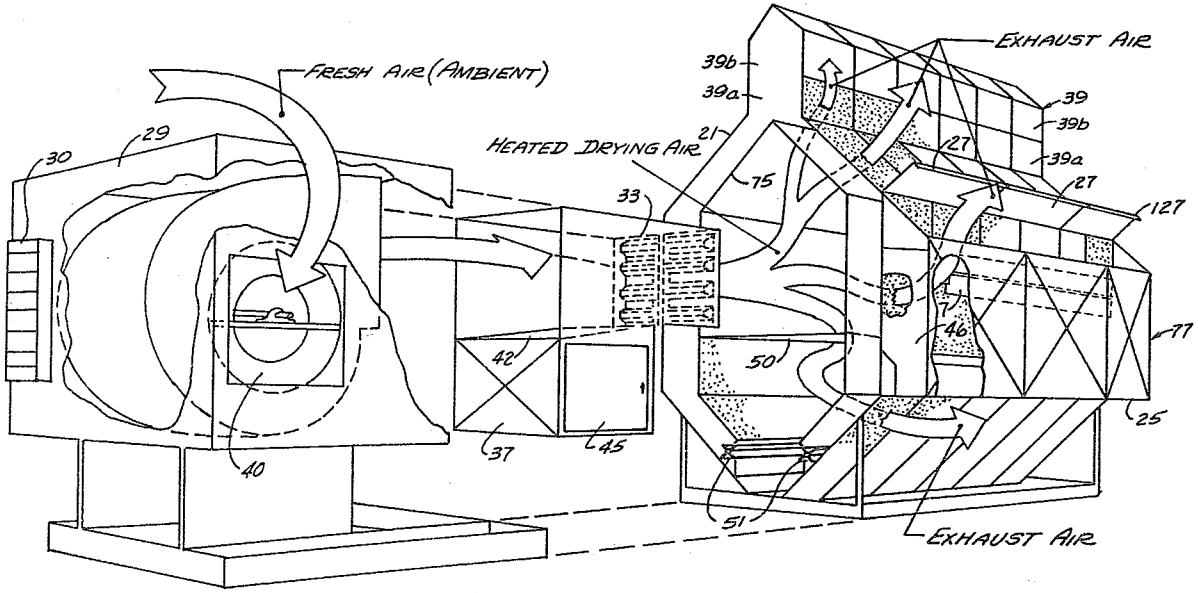
FIG. 18 is a partial cutaway segmented isometric view of the preferred embodiment showing the airflow patterns during Mode III and V drying; i.e., pressure heat in both upper and lower zones with no cooling and full exhaust.

A third position that is very important is a centered position A shown in FIGS. 4, 14 and 20 where the butterfly valve 7 is placed vertically or in a neutral position. This position is used when all or nearly all of the airflow is to be recycled (FIG. 14) or when none (FIGS. 17 and 18) of the airflow is to be recycled.

It becomes quite evident of the extremely useful and valuable contribution this valve makes to the efficiency and capacity of the dryer. When medium to high moisture grain is being dried using Mode I drying (pressure heat, suction cool with recycled cooling and exhaust air), butterfly valve position "C" (FIGS. 13, 16 and 20) would probably be selected. Top exhaust doors 27 and 127 would be open, and return air control doors 46 would be open, thus recycling only the lower $\frac{1}{3}$ of the airflow from the lower position of the drying zone, and exhausting $\frac{2}{3}$ of the air from the vertical sidewall.

When the grain requires low to medium moisture removal, butterfly valve position "B" (FIGS. 15 and 20) would be selected. Top exhaust doors 27 and 127 would be open, and the return air control door 46 would be open, thus recycling approximately $\frac{2}{3}$ of the exhaust air and exhausting $\frac{1}{3}$ of the air from the lower part of the drying zone.

A third condition may exist during Mode I drying (FIG. 13) when low moisture removal drying yields exhaust air quality from the lower half of the drying zone that is fully reusable. In this situation, butterfly valves are placed in the "A" or vertical position (FIGS. 13, 14 and 20). Top exhaust doors 27 are closed, and top exhaust door 127 is open to provide relief from pressure build-up in the exhaust duct 77. Recycled air control doors 46 are open. Thus, all exhaust air from the lower drying zone is recycled unless excess pressure forces some air through door 127, or excess suction draws some ambient air into the duct.

When grain with combustible oil or dust particles such as safflower, sunflowers or milo (grain sorghum) is being dried, using Mode II drying (pressure heat, pressure cool, full exhaust) all of the air exhausting from the sidewall may be unsuitable for recycling. This valve position "A" (FIGS. 4, 17 and 20) would be selected, top exhaust doors 27 and 127 (FIG. 17) would be open, and return air control doors 46 (FIGS. 4 and 17) would be closed, exhausting all drying airflow. The air splitter door 42 would be partially open depending upon the amount of cooling desired in the lower portion of the air column.

Figure 24:
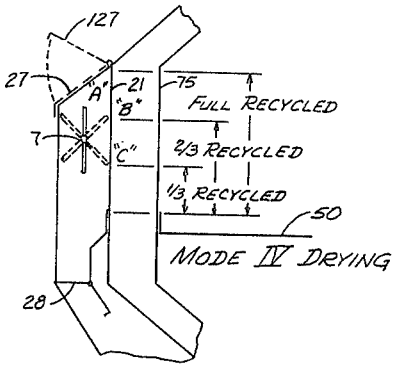
FIG. 24 is a schematic view like FIG. 20, showing three operating positions of the butterfly valve during Mode IV drying.
Figure 19:
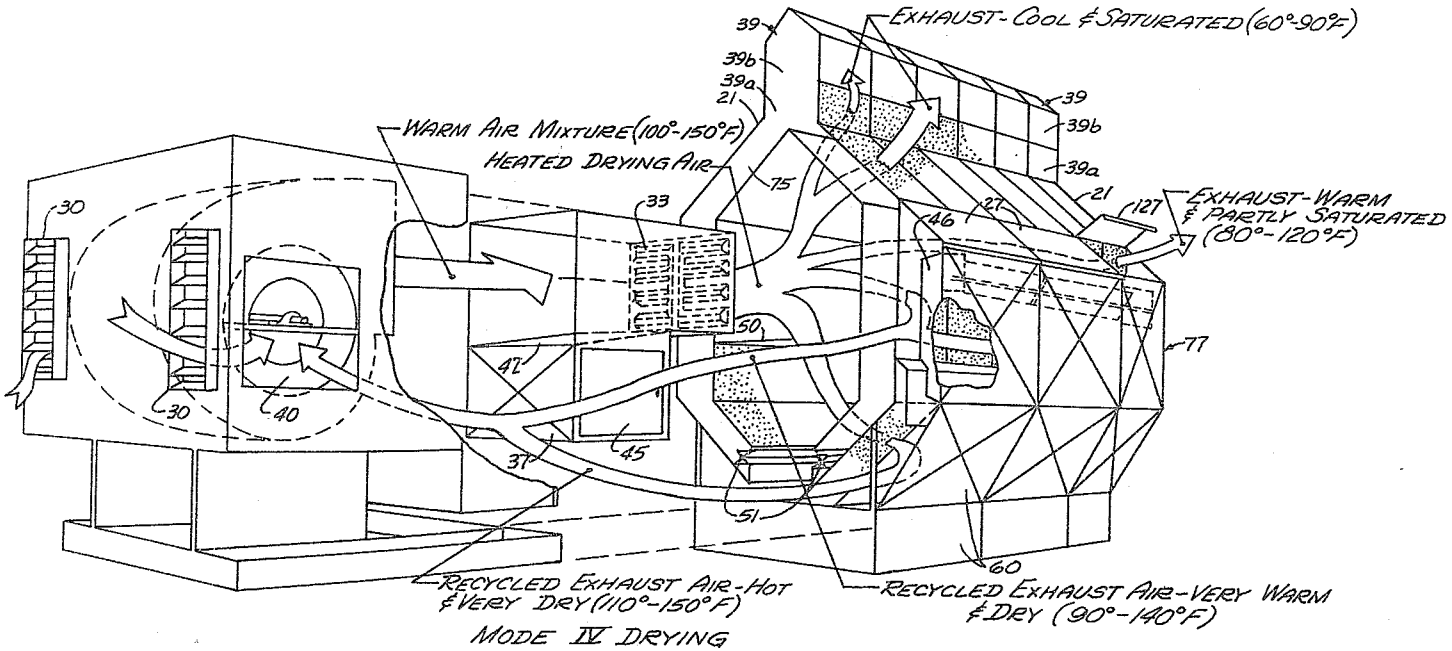
FIG. 19 is a partial cutaway segmented isometric view of the preferred embodiment showing the airflow patterns during Mode IV during; i.e., pressure heating in both upper and lower zones and no cooling, but with recycling of exhaust air from the lower zone and from the lower part of the upper zone.

The butterfly valve 7 also has a very important function during "dryeration" or Mode IV drying when both the upper and lower plenums are used for pressure heat drying with the lower portion of the dryer enclosed by impervious siding 60, FIG. 19, such that air exhausting from the lower plenum zone 59 below the drying exhaust ducts 77 can be recycled and the air in the exhaust ducts 77 can be controlled for recycling or exhausting as discussed previously for normal pressure heat, with suction cool drying. FIG. 24 shows the position of exhaust doors 27 and 127, valve 7, and cleanout doors 28 during the FIG. 19 dryeration, Mode IV drying.

When using Mode III drying (FIG. 18, full pressure heat, continuous drying in both plenums with full exhaust) or Mode V drying (same as Mode III, except that the metering rolls 51 are not operating) such as for rice drying, "dryeration", or "combination drying" of safflower, sunflowers or milo when no cooling is needed, the butterfly valves 7 and 17 are placed in position "A", top exhaust doors 27 and 127 are open, and return air control doors 46 are closed.

The blower 40 (FIG. 3) is mounted to the base frame 11 and is connected to the dryer upper or heat plenum chamber 58, and front bulkhead 47 by an airflow transition assembly 37. The airflow transition assembly 90 contains a straight through air duct where air from the outlet of the blower 40 passes across burner 33, heating the air as it passes into heat plenum 58. The bottom of the upper air duct portion of the transition is a hinged panel 42 (FIG. 3) adjustably controlled to selectively position the panel or "air splitter" (see U.S. Pat. No. 4,268,971) to divert a desired portion of the blower outlet air into the air control box below the air splitter panel 42 that makes up the lower portion of the airflow transition assembly. Door panels 45 on the air control box 37 are closed when the air splitter is open and are open when the air splitter is closed. Under certain conditions which will be clearly seen later, both the top 42 and side panels 45 of the air control box may be closed for a specific use, but the dryer is never operated with both panels 42 and 45 open.

Figure 3:
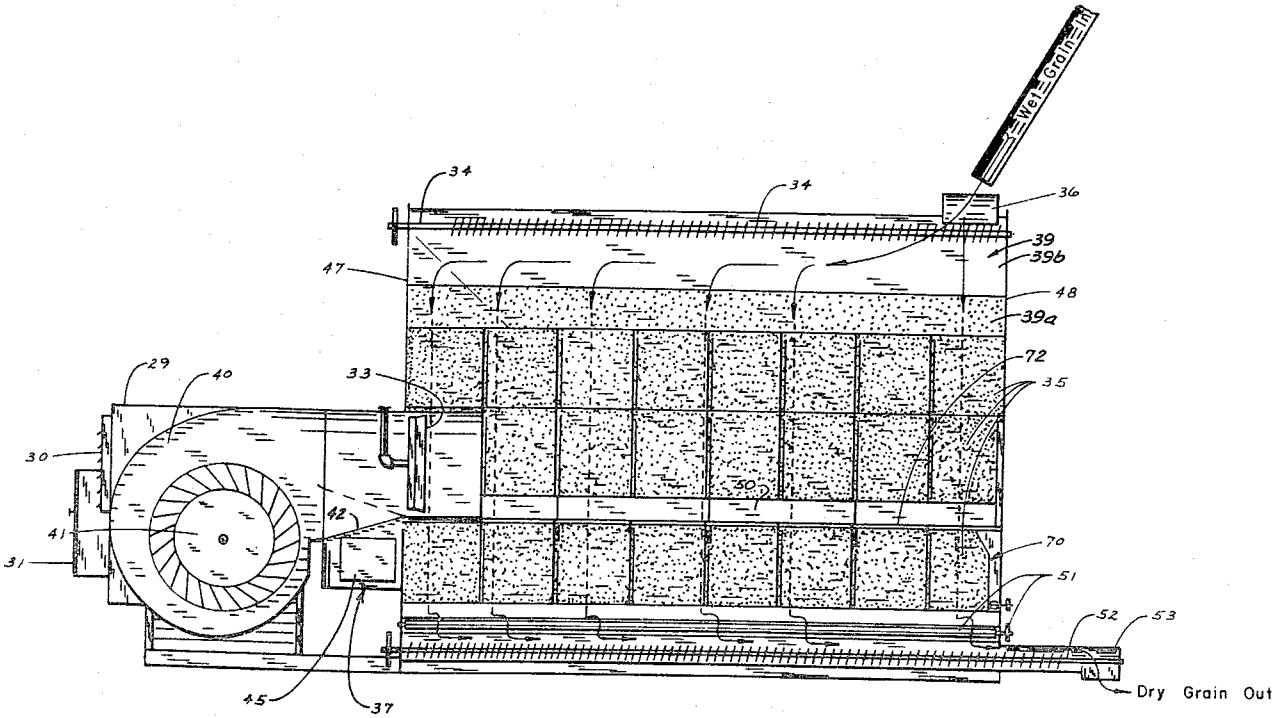
FIG. 3 is a cross-sectional view taken along line 3—3 of FIG. 2.

A weathershield air duct panel housing 29 with louvers 30, (FIGS. 1, 2 and 3) surrounds the blower and transition structure on all sides and connects to the air duct assembly 77 (FIG. 5) mounted on the sidewall of the dryer to effectively route all exhaust drying air from air duct assembly 77 and all of the suction cooling air from the air control box 37 of the airflow transition assembly 89 (FIG. 3), back to the inlet 41 of the centrifugal blower 40, along with providing control of the amount of cooling airflow from the cooling louvers 30 (FIG. 3). The airflow function can also be carried out by vaneaxial and other types of air moving devices.

Figure 9:
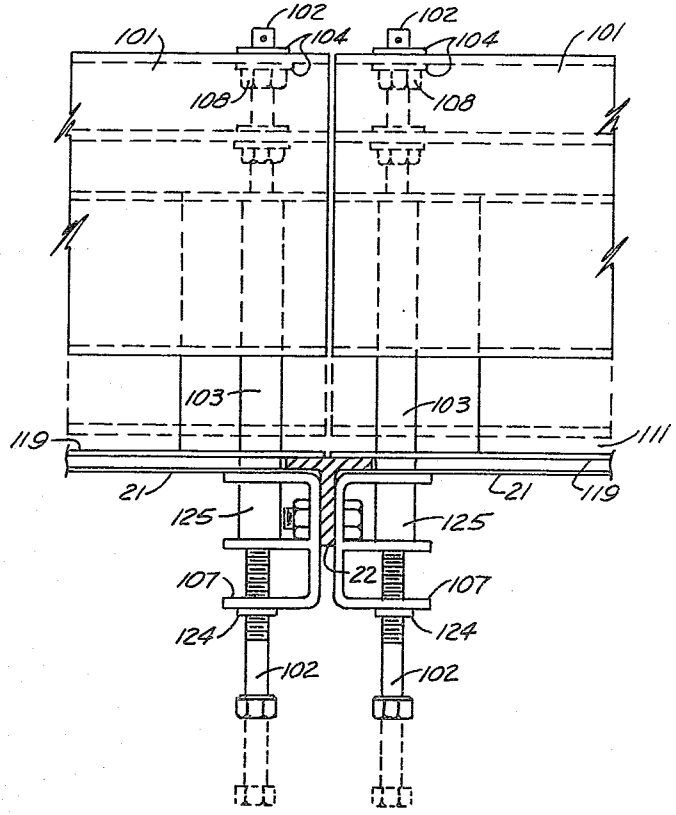
FIG. 9 is a partial inclined side view of the end and intermediate adjustment apparatus for controlling meter gate grain flow gaps taken along line 9—9 of FIG. 8.
Figure 8:
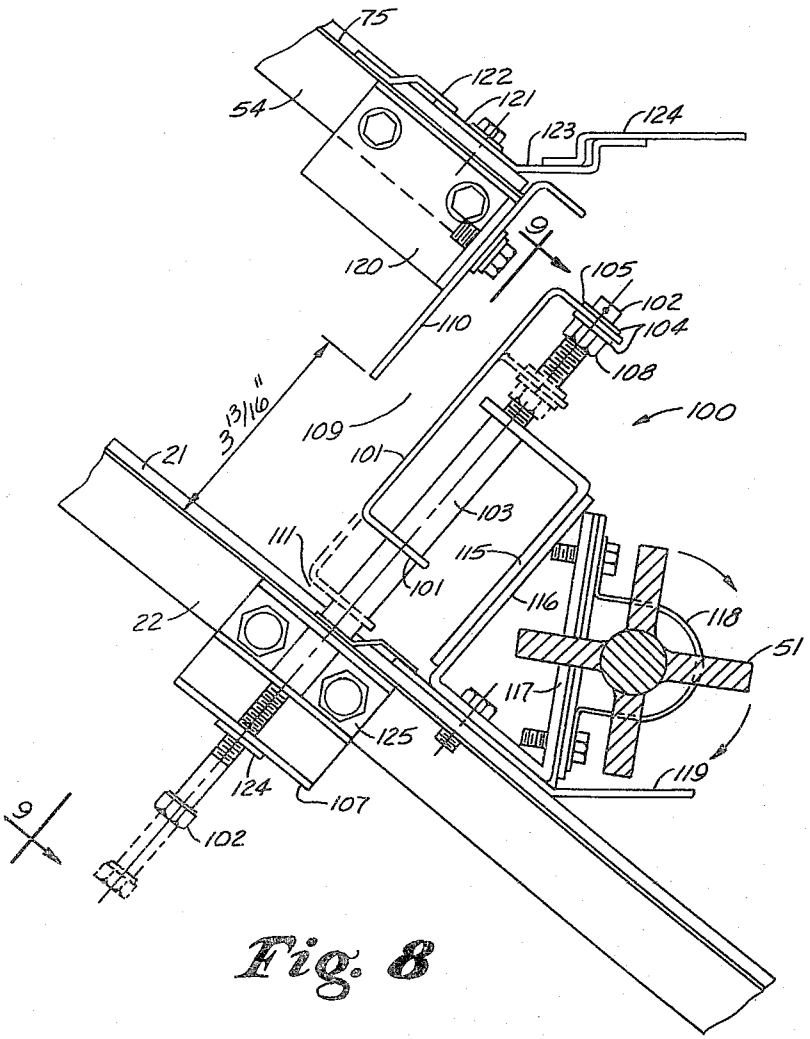
FIG. 8 is a detailed partial close-up end view of one externally adjusted grain flow control gate of the metering system at section 4—4 of FIG. 1.

A novel method of controlling the thickness of the flow of grain to the metering means from external the dryer while the dryer is operating is illustrated best in FIGS. 8 and 9. This grain flow control apparatus 100 consists of formed channel members 101, mounted end to end the full length of the grain dryer, that are supported and adjusted by bolts or threaded adjusting rods 102 near each of each channel, passing through threaded brackets 107 and pipe sleeves 103, then passing loosely through a hole in the upper flange 105 of the channel 101 and retained by fasteners 104 on each side of the flange 105 that provide an upper and lower bearing surface for the flange 105. The channel's lower flange 106 is slotted to provide a saddle such that the channel web is approximately parallel to the adjusting rod 102 and pipe sleeves 103. The channels 101 are incrementally adjusted by turning the bolt 102 so that as the bolt 102 advances or retreats through the threaded bracket 107 (much like a screwjack). The channel 101 is moved upward or downward along the pipe sleeve 103 causing a widening or narrowing of the gap 111 between the lower channel flange 105, FIG. 8, and the lower outer grain column wall 21 which forms one side of the entrance of the metering hopper adjacent the metering rolls 51. An important design consideration is the ease of removal of the metering gate channel 101 for cleanout of the grain column or removal of large objects. This is easily accomplished by removing the retainer clip or lock nut from the top of the bolt or threaded adjusting rod 102 at each end 105 of the channel 101, then sliding the channel 101 up along the pipe 103 and rotating the top flange 105 of the channel 101 up along the pipe 103 and rotating the top flange 105 of the channel 101 inward and downward toward the unload conveyor 52 in the center of the dryer 10. Replacement is done by reversing the removal process.

Another advantage of this part of the invention is that a clearance gap 109 can be maintained between the grain retainer panel 110, FIG. 8, due to the relationship of the angle of repose of the grain compared to the width of the gap, and the elevation of the top flange of the channel compared to the bottom edge of the grain retainer panel 110. This gap 109 greatly reduces assembly time and the critical fit of components during assembly.

Still another feature of the design is that precise adjustment of each channel section 101 can be made from outside the dryer by measuring the exposed bolt extension from the threaded bracket 107, FIG. 8. This allows the dryer operator to set a uniform metering throat gap 111 throughout the dryer for uniform metering flow, while also having the capability of setting non-uniform settings in sections of the dryer where it is determined that a grain flow of a different rate is highly desirable. These settings can be made within minutes without interrupting the drying operation as compared to conventional adjustments that must be made within the dryer, which requires several dryer shutdowns and cooling of the dryer plenum to achieve precise settings, a process which becomes quite frustrating to the operator, and counterproductive to the drying operation.

A further major advantage of this novel apparatus is that a wide range of opening can be made without modification of the dryer mechanically. This is quite important when drying crops of diverse physical characteristics and physical properties. For example, (1) soybeans, which are large, round, and heavy (60 lbs. per bushel); (2) corn, which is large, rectangular, flat or rounded, and heavy (56–58 lbs. per bushel); and (3) wheat, which is intermediate, tapered, and heavy (60 lbs. per bushel) may be dried by the same dryer as (4) oats, at 32–34 lbs. per bushel, and (5) sunflowers, at 24–32 lbs. per bushel (when immature, 16–20 lbs. per bushel) without modifications. The lightweight, bulky grains dry much faster than the heavier grains, thus requiring a very wide throat gap opening 111 to avoid having to modify the metering drive train, compared to the heavy dense grains. Rice must be handled at a very high throughput rate to keep kernel temperature below critical levels that would greatly impair quality and thus selling price, while maintaining adequate capacity. Rice must be passed through the dryer several times since all the moisture cannot be removed during one pass without severe heat stress cracking and extreme quality loss.

The wet grain in the upper portion of the drying zone can tolerate a higher drying temperature during the "Constant Rate" period of drying than the partially dried grain in the lower portion of the drying zone when moisture removal is decreasing. It is desirable to provide temperature separation, but without adding substantial cost and complexity to the dryer structure. It is also well-known that air within a plenum chamber does not flow in a laminar homogeneous fashion, but is turbulent and has currents that flow in varied fashion through the plenum, varying even between dryers of like make, size, and identical design due to difference in management settings. Thus, merely modifying the burner unit to provide more heat at the top than the bottom of the plenum will not assure that excessive temperatures and hot spots will not occur at various locations in the lower plenum; and, likewise, low temperature spots may occur in the top of the plenum due to air current variations.

Figure 22:
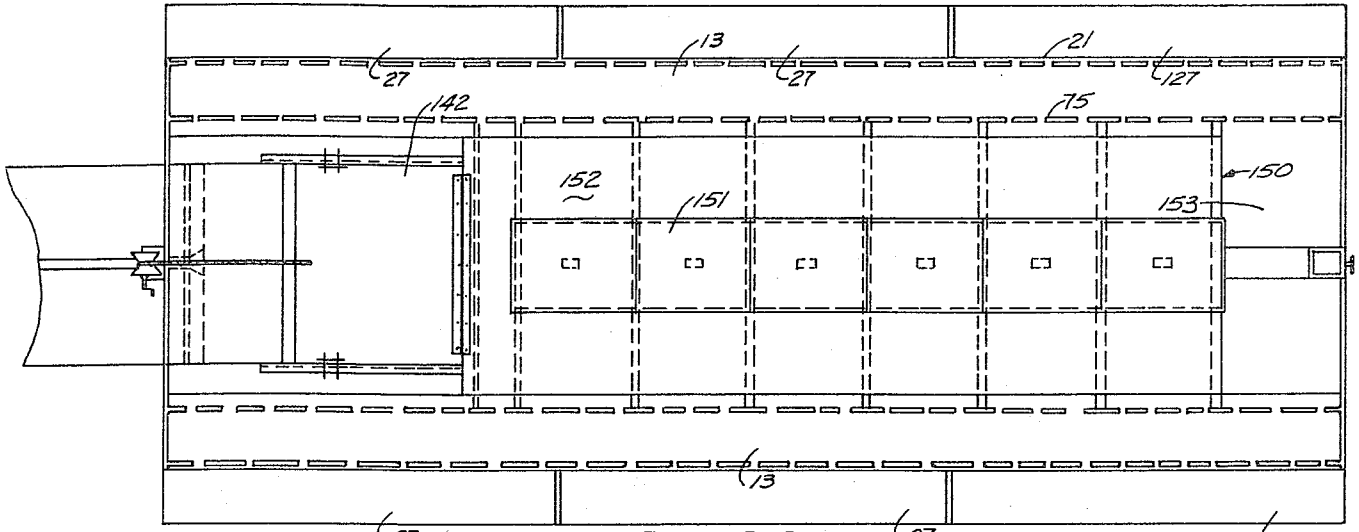
FIG. 22 is a cross-sectional view taken along line 22—22 of FIG. 21.
Figure 23:
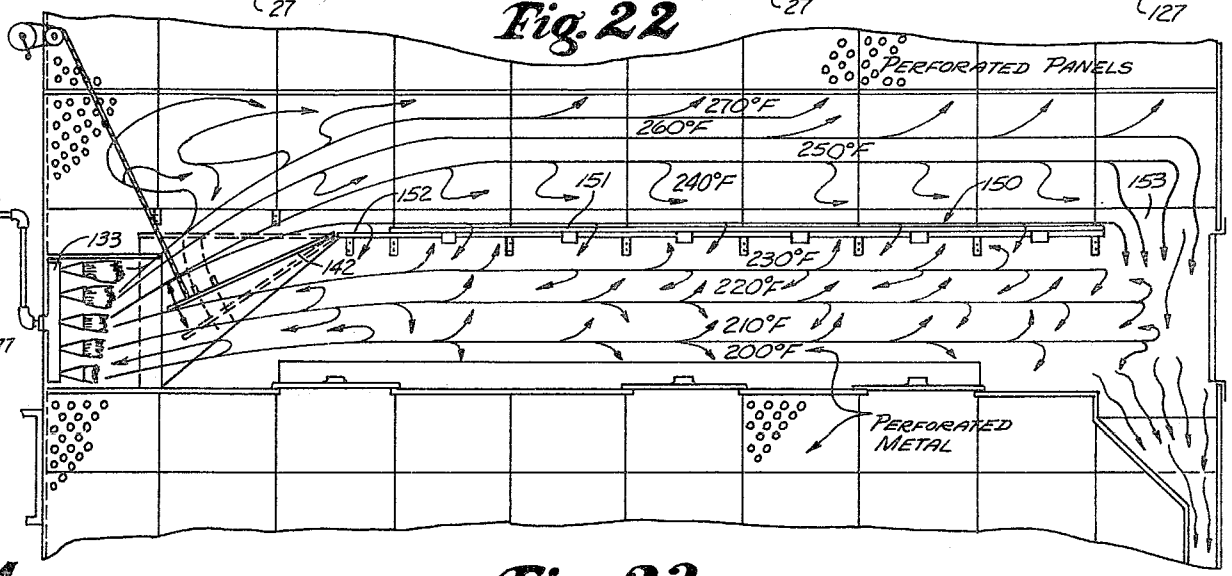
FIG. 23 is a partial cross-sectional view taken along line 23—23 of FIG. 21.
Figure 21:
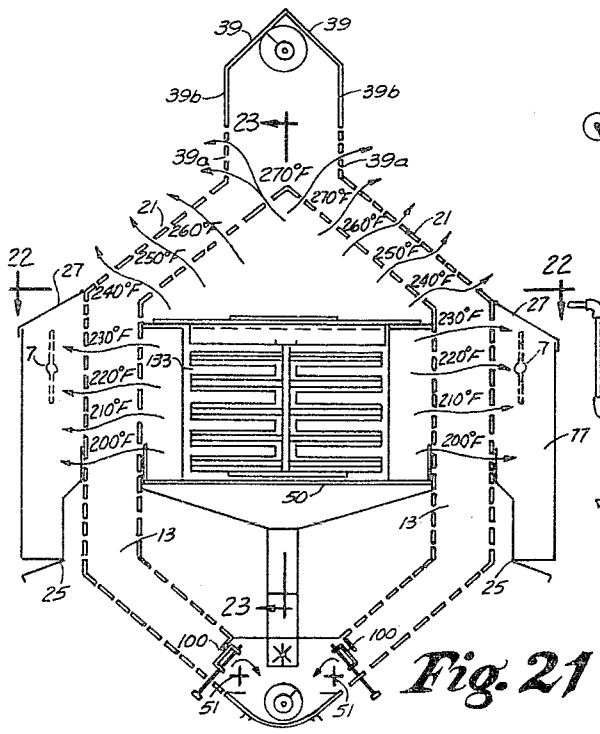
FIG. 21 is a cross-sectional view like FIG. 14, but showing a further embodiment of the present invention.

To improve the dryer operation by being able to provide segragated drying air temperatures without developing separate air sources, separate burners, and a complete plenum divider structure between the upper and lower drying zones in the heat plenum, which would add substantially to the dryer cost and complicate maintenance, due to difficult access to the upper plenum, a composite design approach was conceived. A burner 135 (FIGS. 21 and 22) was designed to deliver a higher heat output at the top and reducing by stages toward the bottom level of the burner to provide a higher temperature airflow immediately adjacent the top of the burner air duct and a lower temperature near the floor. This can be done simply by providing more or bigger orifices in the burner where more gas (more heat) is desired, or more gas can be supplied to the burners at higher levels by valving the output at each level. An example of the temperature stratification can be seen in the schematic cross-sectional views of the grain column designs in FIGS. 10, 11 and 12.

Then, an adjustable air deflector duct 142 (FIGS. 21 and 22) is used to segregate the airflow from the burner 135 to provide slightly more than the appropriate amount of the air volume to the upper half of the grain column in the upper drying zone. This inclined adjustable deflector duct 142 forces the air through an opening in the partial plenum divider 150, including solidly affixed parts 152 and removable panels 151, which separate the upper part 160 from the lower part 161 of the upper heat plenum zone 58. The partial plenum floor 150 extends to a point near the rear wall of the heat plenum zone chamber 58, leaving an opening 153 to provide for airflow between the upper and lower portions of the upper chamber 58. With a designed and controlled amount of excess air in the upper part 160 above plenum floor 150, the lateral air velocity sweeps grain particles, dust, and other foreign matter to the rear opening 70 where the material is carried downward by the excess airflow to the hopper of the automatic cleanout device 73 (as disclosed in U.S. Pat. No. 4,268,971)

for expulsion from the heat plenum 58. Center panels 151 of the upper heat plenum divider 150 are easily removable to facilitate inspection and cleaning of the stationary upper plenum divider panels 152.

In summary, the valves 7 in each exhaust duct 77 are used in conjunction with top and bottom exhaust vent doors 27 and 28 to selectively separate or proportion as desired and therefore contorl the exhaust air for recycling volume and humidity control.

By indepth analysis and computer simulation, the grain column was redesigned to provide optimum use of the blower energy for increased dryer efficiency and capacity. By carefully observing the exhaust air psychrometric state conditions through the length of the drying air exhaust zone, it became apparent that excessive air horsepower is required in the prior art to dry in the upper portion of the heat zone and cool in the cooling zone. The dryer grain column thickness was redesigned and tested to conform the computer simulation; for example, as shown in FIGS. 11 and 12.

A more positive means of control was needed for continuous column grain dryers whereby grains of all densities could be controlled uniformly (while the dryer is operating, if desired). A precision means 100 of setting all sections of the metering gate throat gap was designed to obtain a uniform grain volume from each section of the dryer, or of being able to precisely set an alternate grain flow throat spacing when desired due to variable dryer airflow rate, drying air temperature differences within the drying column, and difference in grain particle size distribution at various stations along the drying columns.

To increase the effectiveness of the increased drying area created by the narrowed upper portion of the grain column (FIGS. 11 and 12), the lower portion **39*a* of the garner bin 39 or wet grain holding column at the top of the structure was made pervious as an extension of the adjacent outer pervious wall. This was a necessity to offset the increased air pressure produced in the garner bin 39 by the thinner upper grain column, as well as to provide a gentle combination of counterflow and crossflow preheat drying of the thickened grain column in the garner section. This perforated preheat section 39*a*** also greatly minimizes the surging of airflow caused by the rising and falling of the grain in a powered (low profile) garner bin. It also greatly minimizes the potential hazard of moist air being forced up the gravity spouts of bucket elevators where it condenses and runs into other grain storage structures causing spoilage of grain in thos structures. The positioning of this perforated section of the garner bin structure is very important. By positioning it adjacent the pervious outer grain column wall, where it is continually covered by moving grain, the grain acts to automatically and continually "wipe" the inner side of the pervious wall, thus keeping it clean while still allowing it to contain "beeswings" and other light weight foreign material too large to be forced through the openings in the pervious wall section. However, pervious panels placed above the grain level would quickly become coated and sealed over from the inside by the airborne foreign material yielding it totally ineffective for allowing preheat air to pass through the grain. If large openings were placed in the garner panels above the grain level, foreign material would be blown out, polluting the air and surrounding area.

A modified burner 133 designed to burn more fuel in the top of the burner than the bottom, is combined with an adjustable air deflector 142 to route a controlled volume of air into the upper heat plenum above a partial plenum separation panel 150 to provide high temperature drying air for the wet grain and lower final drying air temperature in the lower drying zone. The plenum floor 150 stops short of the rear of the heat plenum so that visual inspection of the upper floor can be made as well as allowing excess air to sweep foreign material to the automatic cleanout hopper 70 at the rear of the heat plenum.

Obviously, many modifications and variations of the present invention are possible in light of the above teachings. It is therefore to be understood that, within the scope of the appended claims, the invention may be practiced otherwise than as specifically described.

I claim:

1. Apparatus for drying and conditioning grain comprising:

wall means including an upper portion, a lower portion and an intermediate portion between the upper and lower portions, for containing and guiding grain downwardly by gravity from the upper portion to the lower portion;

airflow means connected to said wall means for permitting air to pass through the grain as such grain moves downwardly;

air circulation means, including an inlet and an outlet for causing air movement;

a plenum chamber in communication with said air flow means;

means for connecting the outlet of the air circulation means to the plenum chamber whereby said plenum chamber is pressurized and air is thereby forced through a first portion of the airflow means for drying the grain;

means for heating the air being forced into the plenum chamber;

recirculation means for selectively directing at least some of the heated air that has passed through the airflow means and grain back to the inlet of the air circulation means, said recirculation means including means for forming a recirculation chamber for receiving said air forced through said first portion of the air flow means;

adjusting means connected to said recirculation means for selectively controlling the amount of air that is recirculated by said recirculation means; and valve means connected to said recirculation means and being disposed in said recirculation chamber for controlling the relative amount of air in said recirculation chamber that is directed back for circulation and the amount of air that is directed to exhaust to atmosphere, said valve means includes a plate means pivotally attached to said recirculation means, said plate means being wider than said chamber for dividing said recirculation chamber into two unequal parts, a recirculation part and an exhaust part, and having a first rotary position wherein one edge of said plate means engages one portion of said airflow means on one side of said recirculation chamber and an opposite edge of said plate means engages one portion of said recirculation means on an opposite side of said recirculation chamber, said plate means having a second rotary position wherein said one edge of said plate engages another portion, spaced from the first portion, of said airflow means on said one side of said recirculation chamber and the opposite edge of said plate member engages another portion, spaced from said one portion, of said recirculation means on the opposite side of said recirculation chamber, said first position of said plate means causing more of said air from said airflow means to be recirculated and less air to be exhausted to atmosphere than when said plate means is in the second position thereof.

2. The apparatus of claim 1 wherein said valve means comprises a butterfly valve.

3. The apparatus of claim 1 wherein said plate means has a third position disposed between said first and second positions thereof for allowing communication between said two parts of the recirculation chamber.

4. The apparatus of claim 3 including means for preventing a buildup of excessive pressures in said recirculation chamber.

5. The apparatus of claim 4 including a butterfly valve means disposed on the same axis of rotation as said plate means but operable independently of said plate means, said butterfly valve means being smaller than said plate means for preventing a buildup of pressure in the recirculation part of the recirculation chamber for insuring that air will flow from the plenum chamber, through the airflow means and grain and into the recirculation part of the recirculation chamber when the plate means is in the first or second position thereof.

6. Apparatus for drying and conditioning grain comprising:

wall means including an upper portion, a lower portion and an intermediate portion between the upper and lower portions, for containing and guiding grain downwardly by gravity from the upper portion to the lower portion;

airflow means connected to said wall means for permitting air to pass through the grain as such grain moves downwardly;

air circulation means, including an inlet and an outlet for causing air movement;

a plenum chamber in communication with said air flow means;

means for connecting the outlet of the air circulation means to the plenum chamber whereby said plenum chamber is pressurized and air is thereby forced through a first portion of the airflow means for drying the grain;

means for heating the air being forced into the plenum chamber;

recirculation means for seelectively directing at least some of the heated air that has passed through the airflow means and grain back to the inlet of the air circulation means;

adjusting means connected to said recirculation means for selectively controlling the amount of air that is recirculated by said recirculation means; and plenum divider means for separating said plenum chamber into a first zone and a second zone, said plenum divider means sealingly movable from a position sealing the first zone from the second zone, whereby the air in the first zone is forced through a first portion of the airflow means, to a position allowing the first and second zones to be in direct fluid communication with respect to each other, whereby the air in the first zone passes directly into the second zone.

7. The apparatus of claim 6 including means for selectively directly connecting the second zone of the plenum chamber to the inlet of the air circulation means for causing ambient air to be drawn through a second portion of the airflow means for cooling the grain when said connecting means is open and causing the air in the second zone to be forced through said second portion of the grain when said connecting means is closed.

8. The apparatus of claim 7 including diverting means for selectively causing a portion of the flow from said air circulation means to be diverted to said second zone of the plenum chamber, upstream of said heating means, whereby said air circulation means supplies ambient air to said second zone and heated air to said first zone or alternately allowing all of the air from the outlet of said air circulation means to pass through the heating means.

9. In an apparatus for drying and conditioning grain comprising: wall means including an upper portion, a lower portion and an intermediate portion between the upper and lower portions, for containing and guiding grain downwardly by gravity from the upper portion to the lower portion; airflow means connected to and extending through said upper, lower and intermediate portions of said wall means for permitting air to pass through the grain as such grain moves downwardly; air circulation means, including an inlet and an outlet, for causing air movement; a plenum chamber in communication with said airflow means; means for connecting the outlet of the air circulation means to the plenum chamber whereby said plenum chamber is pressurized and air is thereby forced through a first portion of the airflow means for drying the grain; the improvement comprising:

said upper portion of said wall means being narrower than said intermediate portion thereof, said upper portion also being tapered and wider at the bottom than at the top thereof.

10. The apparatus of claim 9 wherein said lower portion of said wall means having said airflow means connected therein is narrower than said intermediate portion.

11. The apparatus of claim 9 wherein said upper portion of the wall means is tapered and is narrower at the top thereof than at the bottom thereof.

12. The apparatus of claim 10 wherein said lower portion of the wall means is tapered and is narrower at the bottom thereof than at the top thereof.

13. The apparatus of claim 9 wherein said wall means is of a thickness to conform to the moisture saturation line of the air passing through said wall means.

14. The apparatus of claim 9 including a garner bin means attached to the top of the upper portion of said wall means for introducing wet grain into said wall means, a lower portion of the garner bin means being perforated to allow heated air from the plenum chamber to flow upwardly therethrough for preheating the grain in the garner bin means and to relieve the air pressure in the garner bin means caused by the variations in grain level and the higher volume of air from the thinner grain column.

15. The apparatus of claim 9 including means for heating the air being forced into the plenum chamber.

16. The apparatus of claim 15 including recirculation means for selectively directing at least some of the heated air that has passed through the airflow means and grain back to the inlet of the air circulation means.

17. The apparatus of claim 9 including metering means disposed below said wall means for controlling the flow of grain through said wall means.

18. The apparatus of claim 17 including a metering roll which is rotatably disposed below said wall means and a gate means disposed above said metering roll said gate means including means for externally controlling the distance of said gate means from one of the walls of said wall means.

19. Apparatus for drying and conditioning grain comprising:

wall means including an upper portion, a lower portion and an intermediate portion between the upper and lower portions, for containing and guiding grain downwardly by gravity from the upper portion to the lower portion;

airflow means connected to said upper, lower and intermediate portions of said wall means for causing air to pass through the grain as such grain moves downwardly;

a plenum chamber within said wall means in communication with said airflow means;

primary plenum divider means for separating said plenum chamber into a first zone and a second zone;

air circulation means, including an inlet and an outlet, for causing air movement;

means for connecting the outlet of the air circulation means to the first zone of the plenum chamber whereby said first zone is pressurized and air is thereby forced through a first portion of the airflow means for drying the grain;

means for heating the air being forced into said first zone of the plenum chamber; and a secondary plenum divider means disposed in the first zone of said plenum chamber for dividing said first zone into an upper part and a lower part.

20. The apparatus of claim 19 wherein said heating means includes means for producing more heat and therefore hotter air from an upper portion of the heating means than from a lower portion of the heating means and means for causing at least most of the hotter air to pass above said secondary plenum divider means and the rest of the air to pass below the secondary plenum divider means such that a higher air flow rate can be sustained above the secondary plenum level where the wetter grain can tolerate a higher energy input.

21. The apparatus of claim 19 including opening means at the end of the secondary plenum divider means opposite to the end thereof closest to the heating means for allowing foreign material to be forced therethrough due to the airflow along the top of the secondary plenum divider means and down through said opening means.

22. The apparatus of claim 21 including receiving means disposed at the other end of said plenum chamber adjacent the bottom thereof for receiving foreign matter and automatically discharging said foreign matter from the plenum chamber.

23. In an apparatus for drying and conditioning grain comprising: wall means including an upper portion, a lower portion and an intermediate portion between the upper and lower portions, for containing and guiding grain downwardly by gravity from the upper portion to the lower portion; air-flow means connected to said upper, lower and intermediate portions of said wall means for permitting air to pass through the grain as such grain moves downwardly; air circulation means, including an inlet and an outlet, for causing air movement; a plenum chamber in communication with said airflow means; means for connecting the outlet of the air circulation means to the plenum chamber whereby said plenum chamber is pressurized and air is thereby forced through a first portion of the airflow means for drying the grain; the improvement comprising:

said upper and lower portions of said wall means having said airflow means therein being narrower than said intermediate portion thereof.

24. The apparatus of claim 23 wherein said upper portion of the wall means is tapered and is narrower at the top thereof than at the bottom thereof.

25. The apparatus of claim 24 wherein said lower portion of the wall means is tapered and is narrower at the bottom thereof than at the top thereof.

26. The apparatus of claim 23 wherein said wall means is of a thickness to conform to the moisture saturation line of the air passing through said wall means.

27. The apparatus of claim 23 including a garner bin means attached to the top of the upper portion of said wall means for introducing wet grain into said wall means, a lower portion of the garner bin means being perforated to allow heated air from the plenum chamber to flow upwardly therethrough for preheating the grain in the garner bin means and to relieve the air pressure in the garner bin means caused by the variations in grain level and the higher volume of air from the thinner grain column.

28. The apparatus of claim 23 including means for heating the air being forced into the plenum chamber.

29. The apparatus of claim 28 including recirculation means for selectively directing at least some of the heated air that has passed through the airflow means and grain back to the inlet of the air circulation means.

30. The apparatus of claim 23 including metering means disposed below said wall means for controlling the flow of grain through said wall means.

31. The apparatus of claim 30 including a metering roll which is rotatably disposed below said wall means and a gate means disposed above said metering roll said gate means including means for externally controlling the distance of said gate means from one of the walls of said wall means.

32. The apparatus of claim 23 wherein said upper portion of said wall means includes parallel air pervious walls.

33. The apparatus of claim 23 wherein said lower portion of said wall means includes parallel air pervious walls.

34. The heating apparatus of claim 32 further including means for providing a uniform increasing heat gradient from the lower portion of the heating means to the upper portion such that the heated air in the plenum chamber is hottest in the upper portion of the first plenum zone where the fresh grain is cooler and can tolerate a higher rate of heat energy transfer, and means for causing the cooler air to flow through said airflow means at the bottom of the lower portion of the drying zone beneath the secondary plenum divider where the grain is warmest and driest, thereby providing an optimum heat transfer profile in proportion to the grain's ability to accept the drying energy.

35. The apparatus of claim 19 including opening means at the sides and end of the secondary plenum divider means, opposite the end closest to the heating means to allow distribution of air flow and equalization of plenum static pressure between the adjacent upper and lower zones of the heat plenum when desired, and for further allowing foreign material from said wall means which falls on the secondary plenum divider means to be blown to an opening at the end of said secondary plenum divider means opposite the heating means for discharging said foreign material automatically from the heat plenum.

* * * * *